US006337957B1

(12) United States Patent
Tamaki et al.

(10) Patent No.: US 6,337,957 B1
(45) Date of Patent: Jan. 8, 2002

(54) IMAGE FORMING APPARATUS AND DEVELOPING DEVICE WITH IMPROVED SELF TONER DENSITY CONTROL

(75) Inventors: Shinji Tamaki, Tokyo; Tsuyoshi Imamura, Sagamihara; Hideo Yoshizawa, Urawa; Junichi Terai, Yokohama; Masayuki Yamane, Yokohama; Kiyonori Tsuda, Yokohama; Kazuhisa Sudo, Kawasaki; Shinichi Kawahara, Tokyo; Shunji Katoh, Sagamihara; Mikio Ishibashi, Yokohama; Tokuya Ohjimi, Kawasaki, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/597,405

(22) Filed: Jun. 21, 2000

(30) Foreign Application Priority Data

| | | |
|---|---|---|
| Jun. 21, 1999 | (JP) | 11-174693 |
| Jul. 1, 1999 | (JP) | 11-187727 |
| Jul. 1, 1999 | (JP) | 11-188219 |
| Sep. 22, 1999 | (JP) | 11-269348 |
| Sep. 27, 1999 | (JP) | 11-272551 |
| May 1, 2000 | (JP) | 12-133005 |

(51) Int. Cl.[7] ..... G03G 15/08
(52) U.S. Cl. ..... 399/29; 399/258
(58) Field of Search ..... 399/258, 260, 399/29, 27; 222/DIG. 1

(56) References Cited

U.S. PATENT DOCUMENTS

| | | | |
|---|---|---|---|
| 4,987,449 | A | 1/1991 | Katoh |
| 5,227,847 | A | 7/1993 | Motohashi et al. |
| 5,244,741 | A | 9/1993 | Nagano et al. |
| 5,659,860 | A | 8/1997 | Sasaki et al. |
| 5,765,079 | A | 6/1998 | Yoshiki et al. |
| 5,771,426 | A | 6/1998 | Oka et al. |
| 5,794,108 | A | 8/1998 | Yoshizawa et al. |
| 5,805,965 | A | 9/1998 | Tsuda et al. |
| 5,822,664 | A | 10/1998 | Oka et al. |
| 5,909,609 | A | 6/1999 | Yahata et al. |
| 5,915,155 | A | 6/1999 | Shoji et al. |
| 5,970,290 | A | 10/1999 | Yoshiki et al. |
| 5,970,294 | A | 10/1999 | Narita et al. |
| 6,070,038 | A | 5/2000 | Imamura et al. |

FOREIGN PATENT DOCUMENTS

| | | | |
|---|---|---|---|
| JP | 8-185052 A | * | 7/1996 |
| JP | 8-278695 | | 10/1996 |
| JP | 10-198171 | | 7/1998 |
| JP | 10-232540 | | 9/1998 |
| JP | 11-044996 | | 2/1999 |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A developing device includes a developer bearing member including an internal magnetic field generating device and configured such that a surface thereof moves to carry and convey a developer including toner and carrier. A developer regulating member regulates a quantity of the developer carried and conveyed by the developer bearing member toward a developing area, and a developer accommodating unit accommodates the developer regulated to be conveyed toward the developing area by the developer regulating member. A toner accommodating unit includes a toner supplying opening opposing a surface of the developer bearing surface of the developer bearing member at a position adjacent to and upstream of the developer accommodating unit in a developer conveying direction. The toner in the toner accommodating unit is taken into the developer on the developer bearing member based on a toner density of the developer on the developer bearing member by a movement of the developer with a conveyance of the developer on the developer bearing member. The developing device further includes a peeling off member that opposes, without contacting, a surface of the developer bearing member in the developer accommodating unit so as to peel off an upper layer part of the developer carried and conveyed by the developer bearing member.

76 Claims, 27 Drawing Sheets

IMAGE FORMING APPARATUS AND DEVELOPING DEVICE WITH IMPROVED SELF TONER DENSITY CONTROL

BACKGROUND OF THE INVENTION

1. Field of the Invention

The present invention relates to image forming apparatuses such as copying machines, printers, facsimiles, etc. and a developing device for use in such image forming apparatuses. The present invention more particularly relates to a developing device and an image forming apparatus using the developing device that uses a two component developer including a toner and a magnetic carrier and that includes a self toner density control device to control the toner density of the developer on a developer bearing member so as to be within a fixed range without using a complex toner replenishing device.

2. Discussion of the Background

An example of a developing device that controls the density of toner in the developer on a developer bearing member without using a complex toner replenishing device is one in which the quantity of developer carried on and conveyed by a developer bearing member, that has an internally disposed magnetic field generating device, is regulated by a developer regulating member. The developer scraped off by the developer regulating member is put in a developer accommodating unit, and toner accommodated in a toner accommodating unit is supplied to the developer carried on the developer bearing member through a toner supplying opening, which is adjacent to the developer accommodating unit upstream in a developer conveying direction and which opposes a surface of the developer bearing member (see e.g. Japanese Laid-open Patent publication No. 9-22178). In this developing device, the toner contacting the developer carried on and conveyed by the developer bearing member at the toner supplying opening is taken into the conveyed developer at the interface between the conveyed developer and the developer in the developer accommodating unit. Once the toner density of the developer on the developer bearing member reaches a certain level, the volume of the developer accommodated in the developer accommodating unit starts to swell and thereby the developer in the developer accommodating unit extends so as to cover the toner supplying opening. As a result, the toner is stopped from being taken into the developer on the developer bearing member from the toner accommodating unit at the toner supplying opening. Thus, the toner density of the developer on the developer bearing member is controlled to be within a fixed range.

Also, a developing device is known in which a second developer regulating member is provided between the developer accommodating unit and the toner supplying opening of the toner accommodating unit so as to have a predetermined gap relative to a surface of a developer bearing member (see e.g. Japanese Laid-open Patent No. 9-197833). In this developing device, as the toner density of the developer on the developer bearing member increases, the thickness of a developer layer on the developer bearing member increases, and the increased portion of the developer layer is regulated by the second developer regulating member to pass the second developer regulating member. The developer thus regulated by the second developer regulating member covers the toner supplying opening located adjacent to and upstream of the second developer regulating member in the developer conveying direction, and thereby the toner is stopped from being taken into the developer being carried and conveyed by the developer bearing member. As a result, the toner density of the developer on the developer bearing member is controlled to be within a fixed range.

Such developing devices as noted above that control the toner density of the developer on a developer bearing member to be within a certain range (such a control is hereinafter referred to as a self toner density control) have an advantage in that a toner supplying unit can be simplified, because a toner density sensor is not required, and further a stirring device such as a paddle screw for stirring the developer can be eliminated. In addition, compared to a two component developing method, less magnetic carrier is required. Therefore, torque of the apparatus can be greatly reduced. From these points, the apparatus can be made compact and the cost of the apparatus reduced. Furthermore, because the toner in the toner accommodating unit can be directly supplied to the developer on the developer bearing member passing a developing area, the toner is promptly supplied to a part of the developer on the developer bearing member, where the toner density has been reduced by passing through the developing area. Accordingly, the developing devices can develop a solid image without decreasing the image density.

However, in such developing devices with a self toner density control capability, background soiling and decrease of image density occasionally occur with the lapse of time. Also, uneven image density sometimes occurs in a widthwise direction of an image, which direction is perpendicular to the direction in which the developer on the developer bearing member is conveyed (hereinafter referred to as the image width direction). The inventors of the present invention have analyzed the causes of the decrease in the image quality, and have found that the followings are some of the possible causes.

First, background soiling and decrease of image density with the lapse of time might be caused by an early deterioration of developer due to insufficient replacement of the developer on a developer bearing member with the developer in a developer accommodating unit. That is, if the developer carried on the developer bearing member is conveyed without being peeled off the developer bearing member at all, the developer on the developer bearing member is hardly replaced with the developer in the developer accommodating unit. If such replacement of the developer is not made, stress to the magnetic carrier in the developer carried on the developer bearing member is increased, which may lead to a deterioration of the magnetic carrier earlier than the magnetic carrier in the developer accommodated in the developer accommodating unit. If the magnetic carrier on the developer bearing member deteriorates earlier than the magnetic carrier in the developer in the developer accommodating unit, even when the developer as a whole in the developing device is not deteriorated so much, the charging capability of the magnetic carrier on the developer bearing member, that acts on a formation of a toner image, might be decreased. The decrease of the charging capability of the developer on the developer bearing member causes background soiling or decrease in the image density, thereby decreasing the image quality. Accordingly, the developer is forced to be replaced earlier than desired.

If a replacement of the developer on a developer bearing member with the developer in a developer accommodating unit is not sufficiently performed, inferior toner charging may also result. Namely, when such a replacement of the developer is not made, the toner in an amount corresponding to a consumed amount of the toner on the developer bearing member, which has been supplied onto the developer bearing member, must be mixed thereupon with the developer so as to be charged. However, when the surface moving speed of the developer bearing member is relatively fast (e.g., several hundred rpm when the developer bearing member is a roller), the toner can not be sufficiently charged in time for development, thereby causing an inferior charging of the toner. In particular, when much toner has been consumed at some parts of the developer bearing member, decrease of image density remarkably appears in such parts compared to other parts, thereby leading to a decrease of the image quality.

Secondly, uneven image density in the width direction of the developer bearing member (i.e., in the image width direction) might be caused by uneven toner charging in the width direction of the developer bearing member. When new toner is supplied to a part of the developer where toner has been consumed, supplying of the new toner might be delayed or the supplying quantity of the new toner might be varied. Such a delay in supplying new toner or an uneven new toner supplying amount causes a decrease in the toner density of the developer at the corresponding parts of the developer, and as a result the toner charging amount increases. In particular, when an image consuming a large amount of toner, such as one having a solid part, is formed, supplying of a sufficient amount of toner to a part of the developer, where the large amount of toner has been consumed, can not be made in time for a next development, and the next development might be performed with developer with decreased toner density at that part of the developer. Also, because toner is rather rapidly taken into a part of the developer where a large amount of toner has been consumed, extra toner may be unnecessarily taken into the part of the developer, leading to a development of a subsequent image with unnecessarily high toner density at that part of the developer.

Further, because toner is not consumed at non-image parts of an image, toner should not be taken into such parts of the developer corresponding to the non-image parts of the image. However, a small amount of the toner might be also taken into such parts of the developer corresponding to the non-image parts of the image, thereby causing an increase of the toner density and resulting in a decrease of the toner charging.

Thus, if uneven toner density or uneven toner charging occurs in the developer on the developer bearing member in the width direction of the developer bearing member, uneven image density is caused in the width direction of the developer bearing member such that a part of the image corresponding to a part of the developer where the toner density is low and the toner charging is high is relatively faint, forming a white strip, and a non-image part corresponding to a part of the developer where the toner density is high and the toner charging is low is relatively dark.

In addition, uneven image density in the width direction of the developer bearing member might be also caused by a variation in the dimension or position of a toner supplying opening of a toner accommodating unit in the width direction of the developer bearing member or by a variation of a magnetic force of a magnetic roller, that is provided inside of the developer bearing member as a magnetic force generating device, in the width direction of the developer bearing member.

Furthermore, the inventors of the present invention have also found that uneven image density in the width direction of a developer bearing member might be also caused by surface roughness of a part of a second developer regulating member opposing the developer bearing member or by an insufficient pressing force of an agitator provided in a toner accommodating unit for pressing the toner to be conveyed. Specifically, the surface roughness of the part of the second developer regulating member opposing the developer bearing member affects the quantity of toner to be taken into the developer. If the surface roughness is uneven in the width direction of the developer bearing member, the quantity of toner to be taken into the developer becomes uneven in the width direction of the developer bearing member, and thereby uneven image density is caused in the width direction of the developer bearing member. The toner pressing force of the agitator in the toner accommodating unit also affects the quantity of toner to be taken into the developer. If the toner pressing force of the agitator is uneven in the width direction of the developer bearing member, and when the toner pressing force is not sufficient to convey toner to a part of the developer where a large amount of toner is necessary for forming, for example, a solid image, the toner cannot be sufficiently taken into such a part of the developer, thereby causing uneven image density in the width direction of the developer bearing member.

The inventor of the present invention has proposed a developing device having a second developer regulating member, in which a developer peeling off member for peeling off the developer on a developer bearing member and a developer stirring member for stirring the developer are provided in a developer accommodating unit for preventing the above-discussed uneven image density from occurring (see e.g. Japanese Laid-open Patent Publication No. 10-232540). In that developing device, all of the developer carried and conveyed by the developer bearing member inside the developer accommodating unit is once peeled off by the developer peeling off member and the peeled off developer is stirred by the stirring member. According to a result of an experiment recently made by the inventors of the present invention with the above developing device, it has been found that the self toner density control is not stable enough and that in the worst case the self toner density control does not appropriately function. Specifically, because all of the developer on the developer bearing member is peeled off in the developer accommodating unit, the peeled off developer is accommodated in the developer accommodating unit one after another until the space in the developer accommodating unit is filled with the peeled off developer. Therefore, when the toner density is increased, it is hard to suppress a movement of the developer on the developer bearing member at the upstream side of the developer peeling off member in the developer conveying direction, such that a developer accumulated portion is not formed as desired upstream of the second developer regulating member in the developer conveying direction.

SUMMARY OF THE INVENTION

The present invention has been made in view of the above-discussed and other problems and addresses the above-discussed and other problems.

Preferred embodiments of the present invention provide a novel developing device and image forming device using the developing device, which prevent background soiling and decrease of image density due to a lapse of time while maintaining a stable self toner density control, and which at the same time perform a satisfactory development without causing uneven image density in the width direction of a developer bearing member, which is perpendicular to a direction in which the developer on the developer bearing member is conveyed.

Preferred embodiments of the present invention also provide a novel developing device and image forming apparatus using the developing device, which performs a satisfactory development without causing uneven image density in the width direction of the developer bearing member while keeping a stable self toner density control.

According to a preferred embodiment of the present invention, a developing device includes a developer bearing member which includes an internal magnetic field generating device and which is configured such that a surface thereof moves so as to carry and convey a developer including toner and carrier. A developer regulating member is configured to regulate a quantity of the developer carried and conveyed by the developer bearing member toward a developing area, and a developer accommodating unit is configured to accommodate the developer regulated to be conveyed toward the developing area by the developer regulating member. A toner accommodating unit is configured to have a toner supplying opening opposing a surface of the developer bearing member at a position adjacent to and upstream of the developer accommodating unit in a developer conveying direction. The toner in the toner accommodating unit is taken into the developer on the developer bearing member based on a toner density of the developer on the developer bearing member by a movement of the developer with a conveyance of the developer on the developer bearing member. According to the preferred embodiment, the developing device further includes a peeling off member that opposes, without contacting, a surface of the developer bearing member in the developer accommodating unit so as to peel off an upper layer part of the developer carried and conveyed by the developer bearing member.

In the developing device of the above preferred embodiment, an upper layer part of the developer on the developer bearing member, which is conveyed to a position opposing the developer accommodating unit, is peeled off by the peeling off member in the developer accommodating unit. The developer thus peeled off by the peeling off member is mixed with the developer accommodated in the developer accommodating part. By this mixing of the developer, the toner taken in the developer is stirred and distributed, and at the same time the charging of the toner is accelerated, and thereby the distribution and the charging amount of the toner in the developer on the developer bearing member are made uniform. A part of the developer thus mixed in the developer accommodating unit is carried by the developing sleeve at the downstream side of the peeling off member in the developer conveying direction together with the developer carried by the developer bearing member without having been peeled off by the peeling off member. The developer on the developer bearing member is regulated by the developer regulating member so as to have a predetermined layer thickness and is then used for development. Because only the upper layer part of the developer on the developer bearing member is peeled off, the effect of peeling off the developer relative to the conveyance of the developer on the developer bearing member is suppressed and thereby the self toner density control is stably performed without being deteriorated.

According to another preferred embodiment of the present invention, the developing device includes a developer stirring member which opposes, without contacting, a surface of the developer bearing member in the developer accommodating unit at a position adjacent to the toner accommodating unit so as to stir a part of the developer carried and conveyed by the developer bearing member, where the toner has been taken into the developer from the toner accommodating unit.

In the developing device of the above another preferred embodiment of the present invention, the upper layer part of the developer on the developer bearing member entered into the developer accommodating part is peeled off by the developer stirring member which opposes, without contacting, a surface of the developer bearing member in the developer accommodating unit at the position adjacent to the toner accommodating part. By this stirring of the developer, the mixing of the developer on the developer bearing member and that accommodated in the developer accommodating unit is performed. Further, by this stirring of the developer, the toner which has been taken in the upper layer part of the developer on the developer bearing member is stirred and mixed with the developer such that the toner density of the developer is made uniform. Thus, the developer in which the toner density is made uniform is carried by the developer bearing member and conveyed to a developing area so as to be used for development.

According to still another preferred embodiment of the present invention, the developing device includes a flexible plate-like member which opposes, without contacting, a surface of the developer bearing member in the developer accommodating unit at a position adjacent to the toner accommodating unit so as to contact a part of the developer carried and conveyed by the developer bearing member, where the toner has been taken into the developer from the toner accommodating unit.

In the developing device according to the above another still preferred embodiment, a flexible plate-like member opposing a surface of the developer bearing member at a position adjacent to the toner accommodating part in the developer accommodating unit contacts the supplied toner existing on the upper layer part of the developer on the developer bearing member entered into the developer accommodating part. When the supplied toner contacts the flexible plate-like member, the flexible plate-like member is bent or restored by a pressure force of the toner attempting to pass the flexible plate-like member, thereby preventing the excessive toner existing on the upper layer part of the developer on the developer bearing member from being conveyed to an area at the downstream side of the flexible plate-like member in the developer conveying direction together with the developer on the developer bearing member. Further, because of the flexible plate-like member, the supplied toner existing on the upper layer part of the developer on the developer bearing member is uniformly distributed in a width direction of the developer bearing member, which is perpendicular to the developer conveying direction.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF PREFERRED EMBODIMENTS

Figure 1:
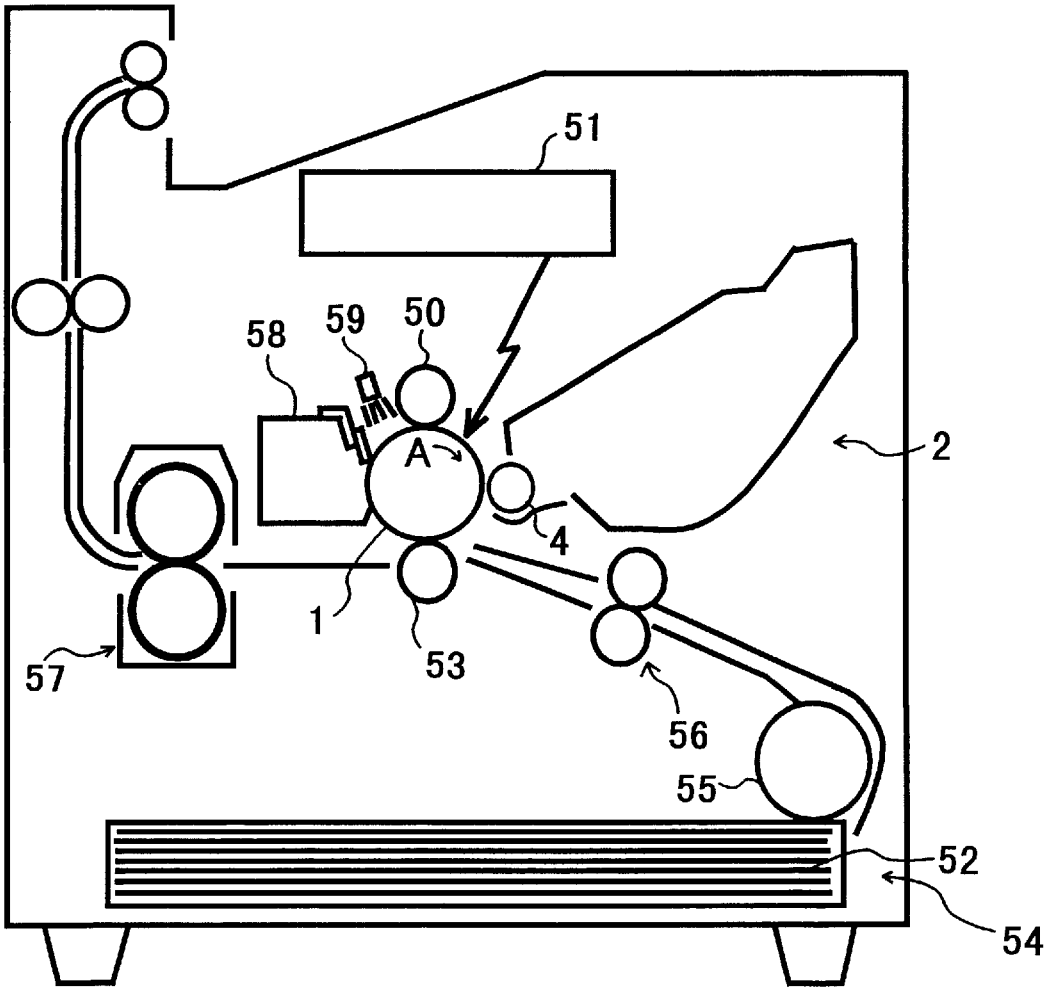
FIG. 1 is a schematic drawing illustrating a laser printer as an example of an electrophotographic image forming apparatus to which a developing device according to an embodiment of the present invention is applied.

Referring now to the drawings, wherein like reference numerals designate identical or corresponding parts throughout the several views, preferred embodiments of the present invention are described.

FIG. 1 illustrates a laser printer (hereinafter referred to as a printer) as an example of an electrophotographic image forming apparatus in which a developing device according to an embodiment of the present invention can be applied.

A photoconductive drum 1 as a latent image bearing member is rotated in the direction indicated by arrow A in FIG. 1, and is uniformly charged, while being rotated, by a charging roller 50 contacting a surface of the photoconductive drum 1. The surface of the photoconductive drum 1 is scanned and exposed by a light according to image information with an optical writing unit 51, thereby forming a latent image thereupon. In this embodiment, a charging roller 50 and the optical writing unit 51 are used for a latent image forming device. However, any other types of charging devices and writing units can be used for the latent image forming device. The latent image formed on the photoconductive drum 1 is developed by a later described developing device 2 so as to form a toner image on the photoconductive drum 1. The toner image formed on the photoconductive drum 1 is transferred to a sheet 52 as a transfer member by a transfer device having a transfer roller 53. The sheet 52 is conveyed from a sheet feeding cassette 54 via a feeding roller 55 and a registration roller pair 56. The sheet 52 after completion of the transfer passes a fixing unit 57, where the toner image is fixed to the sheet 52, and the sheet 52 is then discharged out of the apparatus. Residual toner on the photoconductive drum 1 is removed from the drum 1 by a cleaning unit 58, and further, residual charge on the photoconductive drum i is removed by a discharging lamp 59.

Figure 2:
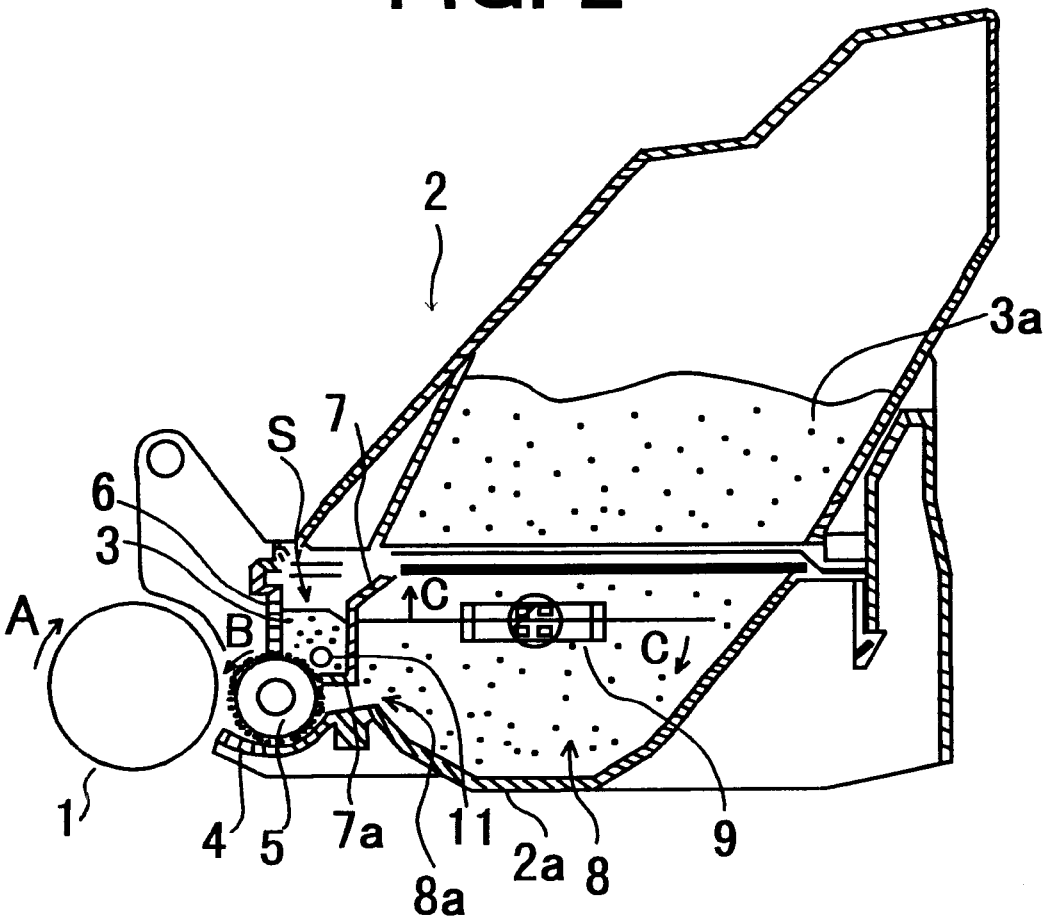
FIG. 2 is a schematic drawing illustrating an exemplary overall construction of the developing device.
Figure 3:
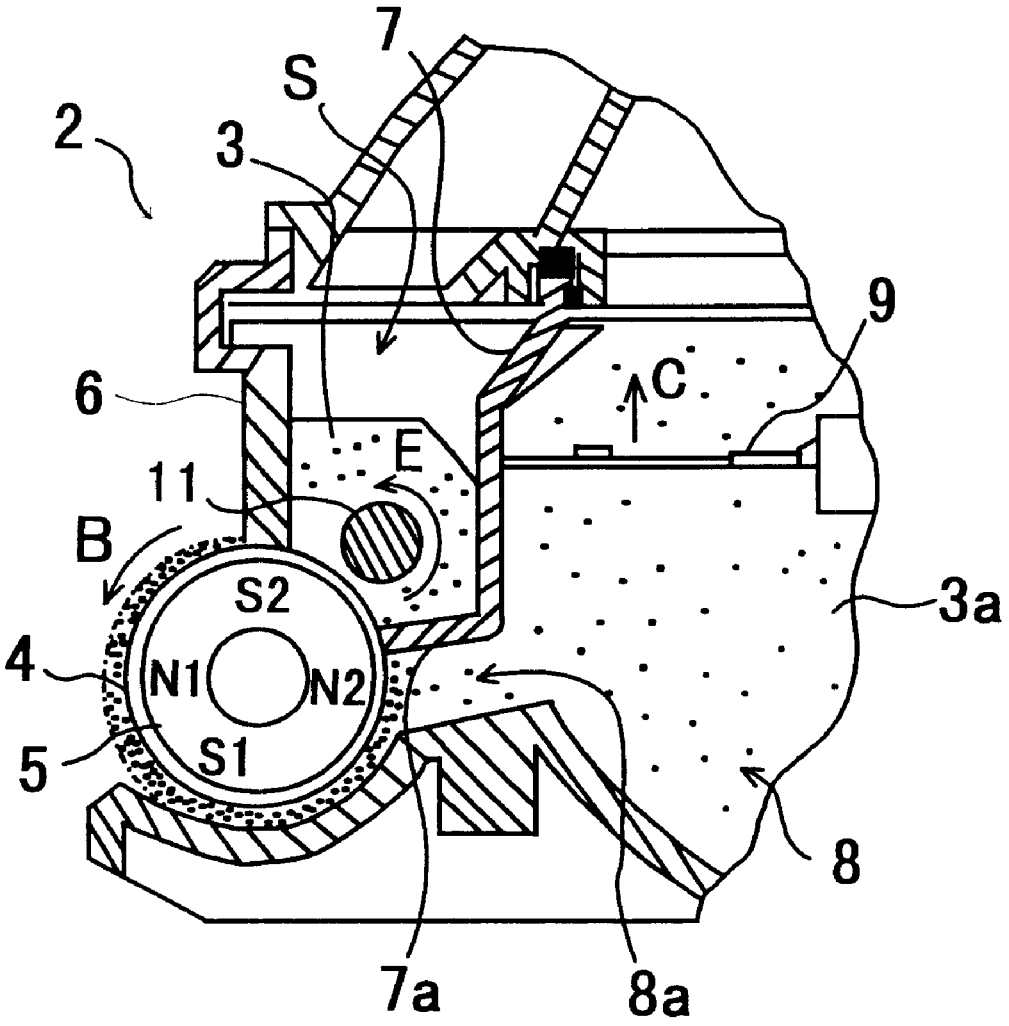
FIG. 3 is an enlarged view of a main part of the developing device.

FIG. 2 illustrates an exemplary overall construction of the developing device 2, and FIG. 3 illustrates a main part of the developing device 2.

The developing device 2 is arranged beside the photoconductive drum 1, and includes a developing sleeve 4 of non-magnetic material as a developer bearing member to carry on its surface a two-component developer 3 (hereinafter referred to as a developer) including a toner 3a and a magnetic carrier (hereinafter simply referred to as a carrier). The developing sleeve 4 is disposed so as to be partly exposed through an opening of a casing 2*a*, that is formed at the side of the photoconductive drum 1. The developing sleeve 4 is configured so as to be driven to be rotated by a driving device (not shown) in a direction indicated by arrow B to convey the developer 3 downward in a developing area opposing the photoconductive drum 1. A magnetic roller 5 including a series of fixed magnets is provided inside the developing sleeve 4 as a magnetic field generating device.

The developing device further includes a doctor 6 as a developer regulating member for regulating the quantity of the developer carried and conveyed by the developing sleeve 4 toward the developing area, a developer accommodating case 7 configured so as to form a developer accommodating part S to accommodate the developer 3 between a surface of the developing sleeve 4 and the doctor blade 6 upstream of the doctor blade 6 in a direction in which the developer 3 is conveyed, and a toner hopper 8 as a toner accommodating part. The toner hopper 8 includes a toner supplying opening 8*a* opposing a surface of the developing sleeve 4 at a position adjacent to and upstream of the developer accommodating part S in the direction in which the developer 3 on the developer sleeve 4 is conveyed. Inside the toner hopper 8, a toner agitator 9 as a toner stirring member is arranged so as to be driven in a clockwise direction indicated by arrow C to stir and convey the toner 3*a* toward the toner supplying opening 8*a*.

An end part (eaves part) of the developer accommodating case 7 in close proximity to the developing sleeve 4 is used as a pre-doctor blade 7*a* as a second developer regulating member that regulates the quantity of the developer, to which the toner 3*a* has been supplied from the toner hopper 8 and which attempts to move toward the developer accommodating part S. The developer regulated by the doctor 6 to move to the developing area is also accommodated in the developer accommodating part S.

A plurality of magnetic poles are formed at a surface part of the magnetic roller 5 so as to extend in an axial direction of the magnetic roller 5. Specifically, a primary pole N1 is disposed in a position opposing the developing area, and a secondary pole S2 is disposed between a position opposing the pre-doctor 7*a* and a position reaching the developing area so that a magnetic force of the magnetic field reaches the developer accommodating part S. Further, as generally practiced in developing devices for an image forming apparatus, magnetic poles (S and N poles) for carrying the developer on the developing sleeve 4 to convey the developer are arranged on a surface of the magnetic roller 5 in an appropriate manner.

In this embodiment, a fixed magnet member in which a magnet piece is engaged with and fixed to a substrate member, a so-called block type magnetic roller, is used for the magnetic roller 5, but any other type of the magnetic roller 5 can be used. For example, a so-called integrated plastic magnetic roller of ferrite system, which is made by magnetizing a plastic magnetic member molded in a certain shape at the same time the magnetic poles are arranged, can be used.

The developing device further includes a peeling off roller 11 as a peeling off member, that opposes, without contacting, a surface of the developing sleeve 4 in the developer accommodating part S so as to peel off a part (a surface layer part) of the developer carried and conveyed by the developing sleeve 4. In this embodiment, a roller-like rotating member formed by a magnetic member is used for the peeling off roller 11, but the peeling off roller 11 can be formed in a cylinder-like shape.

For the peeling off roller 11, a magnetic member such as a SUM member (sulfur and sulfur-mixed finely-ground steel member), a SUS member having magnetism, steel, nickel, and so forth, can be used. Also, a steel core plated with nickel and a stainless member coated with magnetic material can be used.

The surface of the peeling off roller 11 is preferably roughened by a sand blasting process and so forth so as to securely carry and convey the developer peeled off the developing sleeve 4. The surface roughness of the peeling off roller 11 may be set, for example, to about 30 $\mu$m as defined by JIS (Japan Industrial Standard). The surface roughness of the peeling off roller 11 may be appropriately set so that the developer can be conveyed according to conditions such as the kind of toner and material of the peeling off roller 11.

The peeling off roller 11 is driven to rotate in the same direction as the developing sleeve 4 (in the direction indicated by arrow E) by a driving device (not shown). Because of this rotation, at a part where the developing sleeve 4 and the peeling off roller 14 oppose each other, the surface of the peeling off roller 14 moves in an opposite direction relative to a surface moving direction of the developing sleeve 4. Thereby, the upper layer part of the developer on the developing sleeve 4 is blocked by the peeling off roller 11 to be securely peeled off the developing sleeve 4. The developer thus peeled off is conveyed with the surface movement of the peeling off roller 11 to separate from the surface of the developing sleeve 4, and is then mixed with the developer in the developer accommodating part S.

Figure 4:
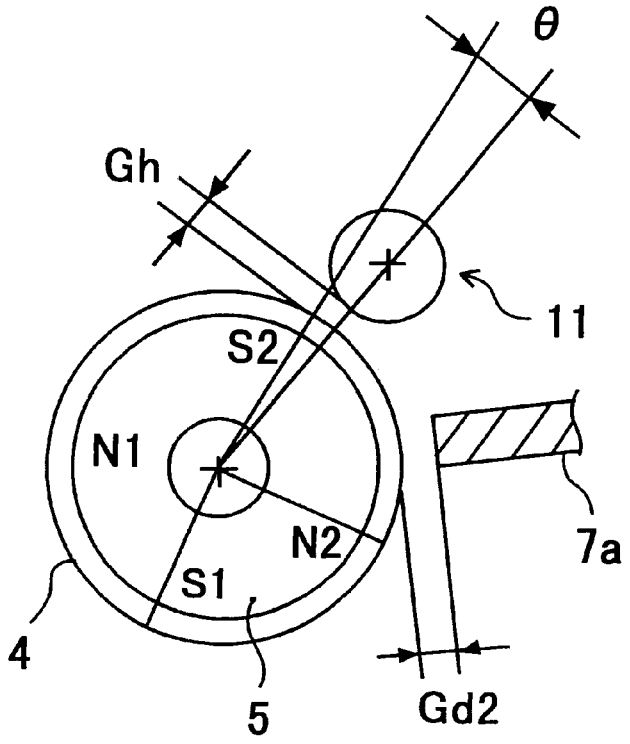
FIG. 4 is a schematic drawing for explaining a positional relationship among a developing sleeve, a peeling off roller, and a pre-doctor of the developing device.

The magnetic pole S2 of the magnetic roller 5 opposing the developer accommodating part S is disposed so as not to be located between the position opposing the peeling off roller 11 and the position opposing the pre-doctor 7*a*. In this embodiment, as illustrated in FIG. 4, the position of the magnetic pole S2 is set so that the angle θ between a line passing through the center of the magnetic roller 5 and that of the peeling off roller 11 and a line passing through the center of the magnetic roller 5 and the magnetic pole S2 is 2–10 degrees.

By thus avoiding the magnetic pole to be disposed between the position opposing the peeling off roller 11 and the position opposing the doctor blade 7*a*, an abnormal flow of the developer in the developer accommodating part S, such as the one attracted toward a gap between the pre-doctor blade 7*a* and the surface of the developing sleeve 4, is avoided regardless of the toner density of the developer.

Further, it is preferable to set a gap Gh between the peeling off roller 11 and the surface of the developing sleeve 4 and a gap Gd2 between the pre-doctor 7*a* and the surface of the developing sleeve 4 so as to satisfy the relation: $0<Gh<Gd2$. By thus setting the gaps Gh and Gd2, the upper layer part of the developer conveyed by the developing sleeve 4, into which the toner has been taken from the toner hopper 8 and which has passed the regulating position by the pre-doctor blade 7*a*, securely contacts the peeling off roller 11 to be peeled off.

When the peeling off roller 11 made of a magnetic member is used, a magnetic pole is generated at a surface of the peeling off roller 11 by a magnetic force action of the magnetic roller 5 in the developing sleeve 4, and thereby the developer 3 on the developing sleeve 4 can be efficiently peeled off. However, because of the magnetic force acting on the peeling off roller 11, the center part of the peeling off roller 11 in the axial direction of the peeling off roller 11 is bent so as to come closer to the developing sleeve 4, and thereby the gap relative to the developing sleeve 4 may become smaller than desired.

Figure 5:
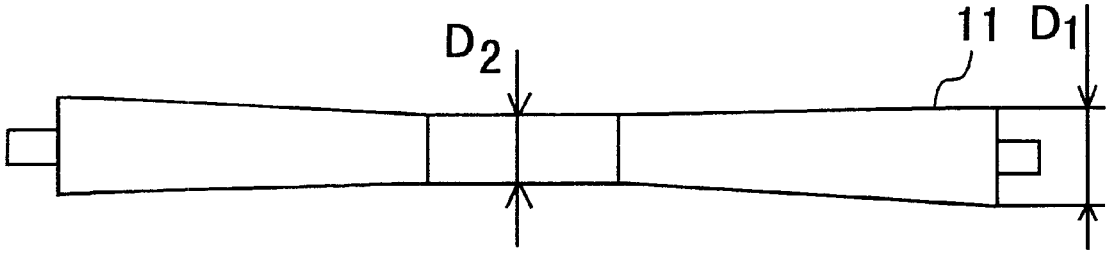
FIG. 5 is a side view of the peeling off roller.

Therefore, when the peeling off roller 11 is configured to be bent as above, as illustrated in FIG. 5, a diameter D2 at the center part of the peeling off roller 11 is preferably made smaller than a diameter D1 of both end parts of the peeling off roller 11. With the use of the peeling off roller 11 configured as above, the gap between the peeling off roller 11 and the developing sleeve 4 can be made substantially uniform over the entire length of the peeling off roller 11 in the axial direction thereof Accordingly, a uniform peeling off operation can be performed over the entire part of the peeling off roller 11 from the center part to the both end parts thereof.

When the peeling off roller 11 is configured not to be bent, the peeling off roller 11 can be formed in a straight rod-like shape having a circular cross-section with a constant diameter over the entire length thereof in the axial direction.

Now, an exemplary developing operation of the above-described developing device is described with reference to FIGS. 2 and 3.

The developer 3 on the developing sleeve 4 is conveyed with a rotation of the developing sleeve 4 in the direction of the arrow B, and is regulated by the doctor 6 so as to be thinly layered. The thinly layered developer 3 is conveyed to the developing area opposing the photoconductive drum 1 rotating in the direction of the arrow A. In this developing area, toner is supplied to a latent image formed on the photoconductive drum 1 to visualize the latent image. The developer on the developing sleeve 4 which has passed the developing area is further conveyed with the rotation of the developing sleeve 4 to reach the position opposing the toner supplying opening 8*a*. At the toner supplying opening 8*a*, the toner 3*a* conveyed thereto by the agitator 9 from the toner hopper 8 halts there so as to contact the developer on the developing sleeve 4. The developer on the developing sleeve 4 returns, after taking the new toner 3*a* therein to at the toner supplying opening 8*a*, to the developer accommodating part S. The developer containing the new toner 3*a* is regulated by the doctor 6 and thereby the internal pressure of the developer increases. The toner is charged by friction with the carrier in the developer having thus increased internal pressure. A part of the developer 3 regulated by the doctor 6 so as not to be conveyed to the developing area is moved so as to be circulated in the developer accommodating part S.

Figure 6A:
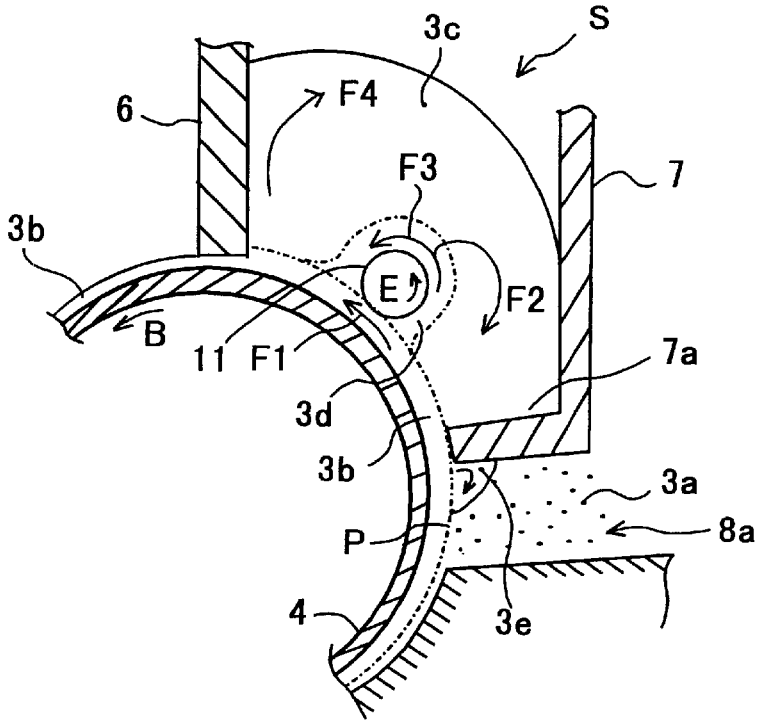
FIGS. 6(*a*) and 6(*b*) are schematic drawings for explaining a self toner density control mechanism in the developing device.
Figure 6B:
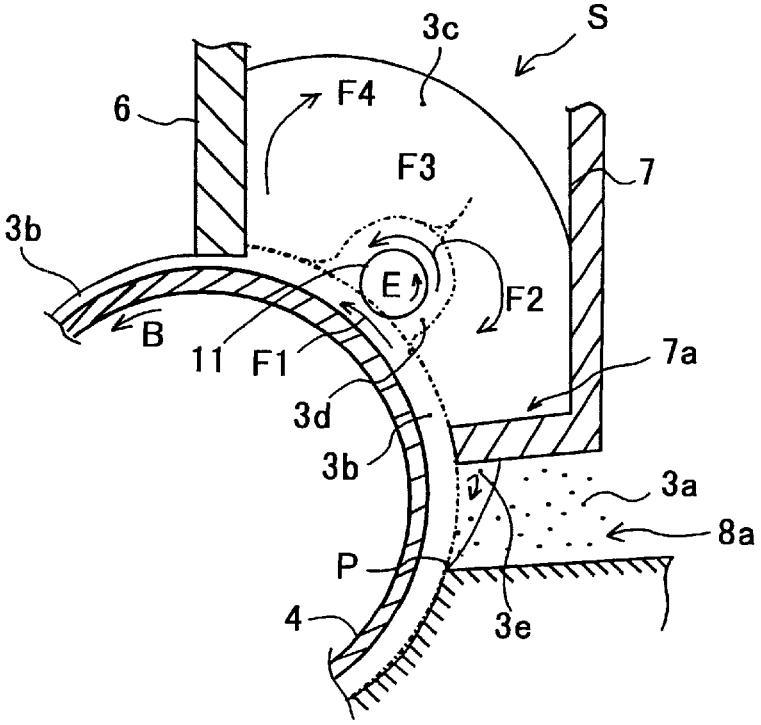

Next, an exemplary self toner density control operation of the developing device is described with reference to FIGS. 6(*a*) and 6(*b*). In FIGS. 6(*a*) and 6(*b*), a two-dot chain line indicates an interface between developers having different behaviors from each other.

First, a developer having a predetermined toner density and a predetermined weight is set in the developing device as an initial developer, and by driving the developing sleeve 4 and the peeling off roller 11 so as to rotate, the developer 3 is divided into three parts, a conveyed developer 3*b*, an accommodated developer 3*c*, and a peeled off developer 3*d*. The conveyed developer 3*b* is the developer that is carried on a surface of the developer sleeve 4 by a magnetic force and conveyed by being brought around by the surface of the developing sleeve 4. The accommodated developer 3*c* is the developer that is accommodated in the developer accommodating part S and that moves in the developer accommodating part S to circulate therein with a movement of the conveyed developer 3*b*. The peeled off developer 3*d* is the developer that is peeled off the conveyed developer 3*b* on the developing sleeve 4 and that moves along a surface of the peeling off roller 11 with a rotation of the peeling off roller 11.

In the developer accommodating part S, as illustrated in FIG. 6(*a*), four developer flows F1, F2, F3, and F4 are generated. The first developer flow F1 is the flow of the conveyed developer 3*b* passing between the developing sleeve 4 and the peeling off roller 11. The second developer flow F2 is the circulating flow of a part of the peeled off developer 3*d* that is peeled off the developing sleeve 4 and that moves along the peeling off roller 11 so as to circulate in a space between the peeling off roller 11 and the pre-doctor 7*a*. The third developer flow F3 is the flow of a part of the peeled off developer 3*d* that flows along a surface of the peeling off roller 11 above the peeling off roller 11. The fourth developer flow F4 is the circulating flow of the accommodated developer 3*c* that rises along a back surface of the doctor 6 due to the regulation by the doctor 6 to circulate in a space between the doctor 6 and the peeling off roller 11.

Under conditions that the above four developer flows F1–F4 are generated in the developer accommodating part S, if the toner 3*a* is put in the toner hopper 8, the toner 3*a* is supplied from the toner supplying opening 8*a* to the conveyed developer 3*b* carried by the developing sleeve 4. The conveyed developer 3*b* to which the toner 3*a* has been supplied is conveyed to the developer accommodating part S together with the supplied toner 3*a*. While the conveyed developer 3*a* is being thus conveyed, the toner 3*a* which has been supplied to the conveyed developer 3*b* slightly shifts toward the axial center of the developing sleeve 4. After the conveyed developer 3*b* to which the toner 3*a* has been supplied passes the regulation position of the pre-doctor 7*a*, the upper layer part thereof is peeled off by the peeling off roller 11 to become the peeled off developer 3*d*. The peeled off developer 3*d* is conveyed while being mixed with the accommodated developer 3*c*, and a part thereof merges with the above circulating developer flow F2 generated in a vicinity of the pre-doctor 7*a*. The peeled off developer 3*d* being carried and conveyed by the peeling off roller 11 is further conveyed while being mixed with the accommodated developer 3*c*, and is then carried again by the developing sleeve 4 downstream of the peeling off roller 11 in the developer conveying direction to become the conveyed developer 3*b*. By this mixing of the peeled off developer 3*d* with the accommodated developer 3*c*, replacement of a part of the peeled off developer 3*d* with the accommodated developer 3*c*, uniform distribution of the toner 3*a* in the developer, and toner charging by a frictional charging between the toner and the carrier are realized.

As the toner density of the developer 3 gradually rises with the above supply of the toner 3*a* to the developer 3, the volume of the developer 3 increases and thereby the layer of t he conveyed developer 3*b* on the developing sleeve 4 becomes thick in the area from the position opposing the toner supplying opening 8*a* to the regulation position by the doctor 6.

Because the ratio of the carrier in the conveyed developer 3*b* on the developing sleeve 4 decreases as the layer thickness of the conveyed developer 3*b* increases, the magnetic force acting on the conveyed developer 3*b* decreases, and thereby the moving speed of the conveyed developer 3*b* decreases, resulting in further increasing the layer thickness of the conveyed developer 3*b* on the developing sleeve 4 in the above area. This conveyed developer 3*b* on the developing sleeve 4 with the increased layer thickness receives a rather strong braking force in a direction of stopping the conveyance of the conveyed developer 3*b* from the peeling off roller 11, and thereby the moving speed of the conveyed developer 3*b* being conveyed toward the peeling off position by the peeling off roller 11 decreases even more.

The upper layer part of the conveyed developer 3*b* with the layer thickness having been increased at the position opposing the toner supplying opening 8*a* is peeled off by the pre-doctor 7*a*, and the peeled off developer starts to halt, as illustrated in FIG. 6(*a*), at an upstream side of the pre-doctor 7*a* in the developer conveying direction. Hereinafter, the halting developer is referred to as halting developer 3*e*. The halting developer 3*e* circulates along with a movement of the conveyed developer 3*b* contacting the halting developer 3*e*. The toner 3*a* supplied to the toner supplying opening 8*a* is attracted to an exposed part of the conveyed developer 3*b*, and is taken into the conveyed developer 3*b* at a merging point P where the conveyed developer 3*b* and the halting developer 3*e* merge with each other.

As the toner density of the developer 3 further increases, as illustrated in FIG. 6(*b*), the quantity of the halting developer 3*e* at the toner supplying opening 8*a* increases so that the exposed surface of the conveyed developer 3*b* contacting the toner 3*a* is closed by the halting developer 3*e* and the merging point P moves up to an upstream end of the toner supplying opening 8*a* in the developer conveying direction, and at the same time, the circulating and moving speed of the halting developer 3*d* at the toner supplying opening 8*a* decreases, and finally the take-in of the toner 3*a* into the developer is completed and the toner density stops increasing.

The upper layer part of the conveyed developer 3*b*, into which the toner 3*a* has been taken and which has passed the gap between the pre-doctor 7*a* and the developing sleeve 4, is peeled off by the peeling off roller 11. The peeled off developer 3*d* is conveyed along a surface of the peeling off roller 11 while being mixed with the accommodated developer 3*c*, and a part thereof is again carried on the developer sleeve 4. The conveyed developer 3*b* which has passed the gap between the developer sleeve 4 and the doctor 6 is conveyed to the developing area opposing the photoconductive drum 1. In the developing area the toner is supplied to a latent image formed on the photoconductive drum 1 so as to be used for development of the latent image.

As the toner 3*a* on the developing sleeve 4 is consumed as a result of the development of the latent image on the photoconductive drum 1, the toner density of the corresponding part of the conveyed developer 3*b* decreases, the conveying force by the developing sleeve 4 acting on that part of the conveyed developer 3*b* increases, and further, the volume of that part of the conveyed developer 3*b* decreases. Then, the layer thickness of the conveyed developer 3*b* regulated by a tip end of the pre-doctor 7*a* decreases, the quantity of the halting developer 3*e* halting in the vicinity of the toner supplying opening 8*a* decreases, and the circulating and moving speed of the halting developer 3*e* increases. Thereby, the conveyed developer 3*b* conveyed by the developing sleeve 4 is caused to contact the toner 3*a* from the toner hopper 8, such that the toner 3*a* is again taken into the conveyed developer 3*b* and the toner density of the developer 3 is increased as described above.

As described above, according to a change of the toner density on the developing sleeve 4, the regulating condition with the pre-doctor 7*a* for the conveyed developer 3*b* on the developing sleeve 4 changes, and thereby the toner density of a part of the developer where the toner has been consumed is self controlled so as to be within a predetermined range. With this self control, the toner density of the conveyed developer 3*b* on the developing sleeve 4 is maintained to be constantly in a fixed range. Therefore, a complicated toner density control mechanism including, for example, a toner sensor and a toner supplying member, is not necessary.

According to the above-described embodiment of the present invention, by peeling off a part of the conveyed developer 3*b* on the developing sleeve 4 so as to be mixed with the accommodated developer 3*c* in the developer accommodating part S, replacement of the conveyed developer 3*b* with the accommodated developer 3*c* is accelerated, so that early deterioration of the developer 3 due to a decrease of the charging capability of the carrier in the developer 3 is prevented. In addition, by mixing the conveyed developer 3*b* with the accommodated developer 3*c*, the toner in the developer 3 is stirred and distributed such that the toner density of the developer 3 is made uniform with respect to an image width direction perpendicular to the developer conveying direction, making it possible to perform a satisfactory development without having uneven image density.

Further, according to the above-described embodiment of the present invention, because the peeling off roller 11 having a circular shape in its cross-section is used, the gap between the circumferential surface of the peeling off roller 11 and that of the developing sleeve 4 does not change even when the peeling roller 11 rotates. Therefore, an uneven peeling off does not occur. Accordingly, variation of the toner density and toner charging is suppressed with respect to the conveyed developer 3*b* on the developing sleeve 4 in the developer conveying direction, and thereby uneven image density in the developer conveying direction can be avoided. According to an experiment made by the inventors of the present invention, when a peeling off member having other shapes than a circular cross-section, for example a crank-like shape, is used, an uneven peeling off occurs, resulting in having uneven image density at a pitch corresponding to a rotation pitch of the crank-like shaped peeling off roller.

According to the above-described embodiment of the present invention, because the peeling off roller 1 made of a magnetic member is used, by magnetizing the peeling off roller 11 by the magnetic roller 5 in the developing sleeve 4, a part of the conveyed developer 3*b* carried on and conveyed by the developing sleeve 4 can be attracted to the peeling off roller 11 by a magnetic force. Accordingly, peeling the developer off the developing sleeve 4 and generating the developer flow to force the peeled off developer to move along a surface of the peeling off roller 11 as indicated by F3 in FIG. 6(*a*) can be made rather remarkably, and thereby mixing and stirring of the peeled off developer with the developer in the developer accommodating part S is further efficiently made.

In the above-described embodiment, the peeling off roller 11 may be configured such that the rotation speed thereof is controlled according to the ratio of an image part and a non-image part of an original document for printing or the result of detecting a temperature and humidity condition in the apparatus.

Figure 7:
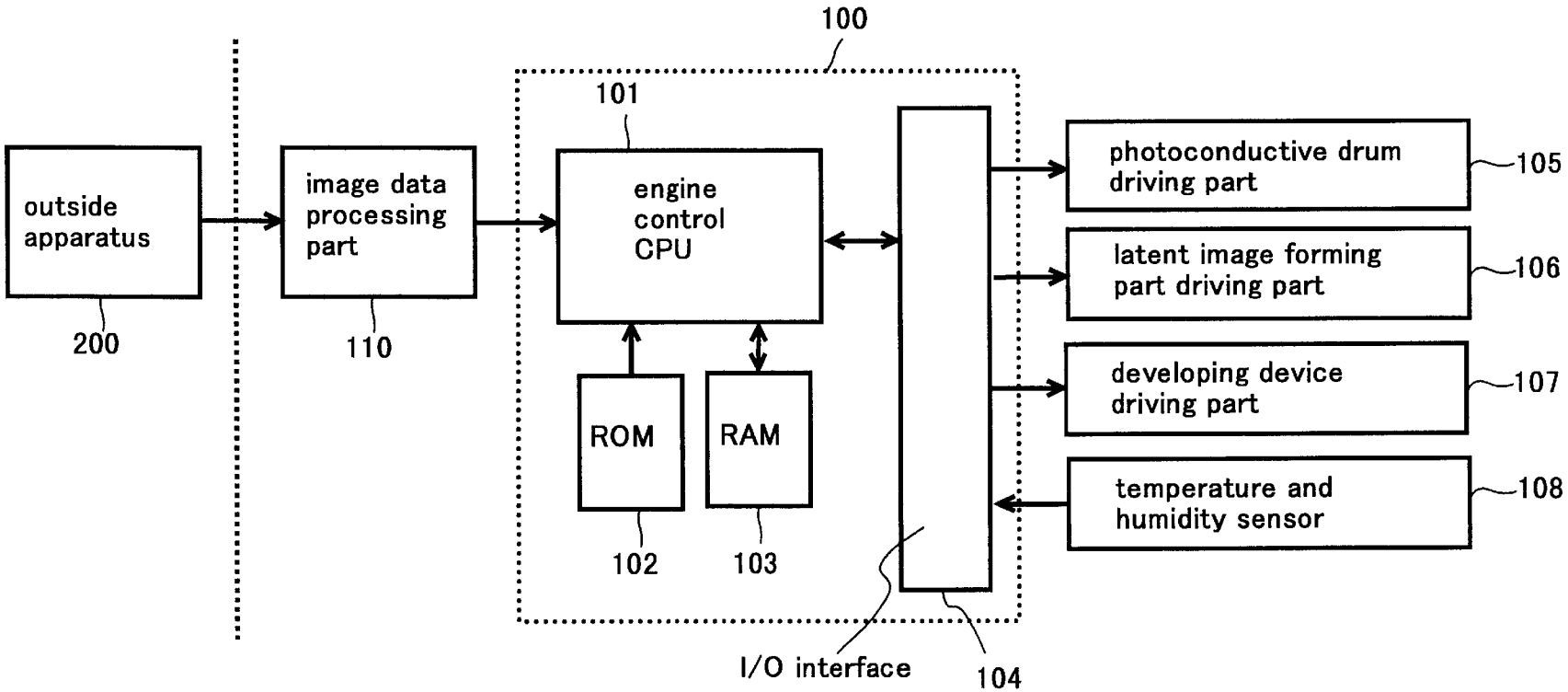
FIG. 7 is an exemplary block diagram of a control part of the laser printer.

FIG. 7 is a block diagram of an exemplary control part of the printer according to the above-described embodiment of the present invention. Image data received from an outside apparatus 200 such as a personal computer is processed by an image data processing part 110. In this image data processing by the image data processing part 110, data for forming a latent image, that is used at the latent image forming part, is generated and the image ratio data of an image for printing is calculated. An engine control part 100 controls each part of the apparatus according to the data sent from the image data processing part 110. The engine control part 100 includes an engine control CPU 101, a ROM 102, a RAM 103, and an I/O interface 104. To the engine control part 100, a photoconductive drum driving part 105, a driving part 106 for the latent image forming part, a developing device driving part 107, and a temperature and humidity sensor 108 are connected. The engine control CPU 101 outputs various instructions to each part of the apparatus so as to be operated according to a control program read out from the ROM 102 and in response to an input signal from the image data processing part 110, while performing various recognition and determination operations such as ones relating to operating timings of respective driving parts. The engine control CPU 101 also controls each part of the apparatus according to temperature and humidity data obtained by the temperature and humidity sensor 108.

The engine control part 100 controls the rotation of the peeling off roller 11 of the developing device 2, for example, according to the image ratio data of an image for printing. More specifically, the circumferential moving speed of the peeling off roller 11 is changed according to a toner consumption, which changes according to the image ratio, so as to appropriately charge the toner and to avoid unnecessary mixing of the developer, thereby preventing a deterioration of the developer.

Figure 8:
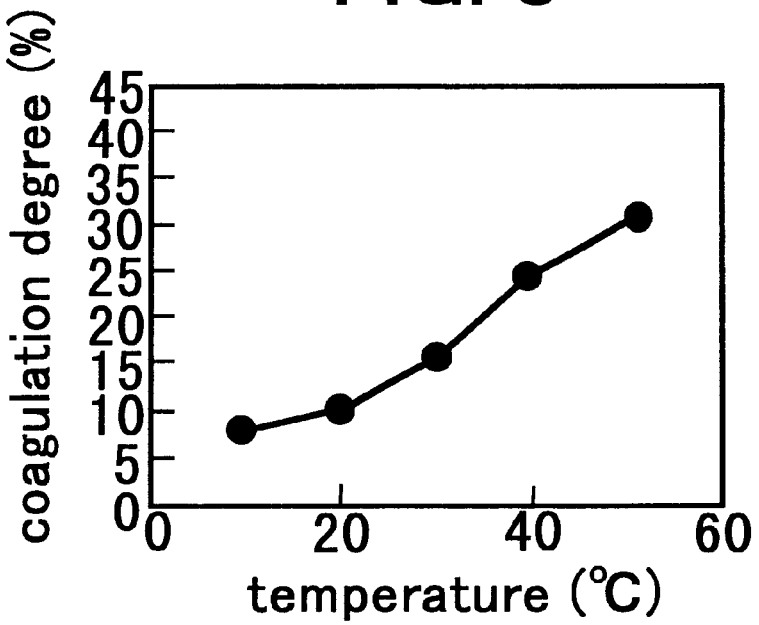
FIG. 8 is a graph explaining a relation between temperature and a coagulation degree of toner.
Figure 9:
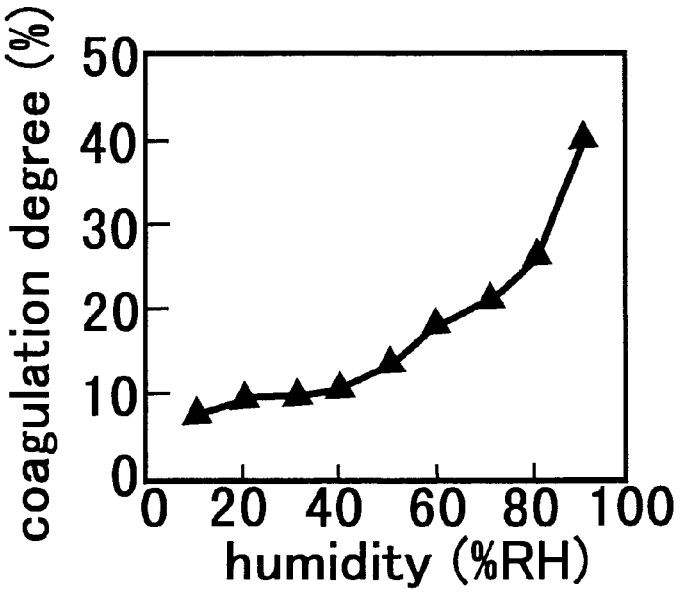
FIG. 9 is a graph explaining a relation between humidity and a coagulation degree of toner.

Further, it has been found in an experiment performed by the inventors of the present invention that the quantity of the taken-in toner 3*a*, the conveying speed of the developer 3, and the volume of the developer 3 change according to the coagulation degree of the toner 3*a*, which changes based on environmental conditions. The coagulation degree of the toner 3*a* changes based on the temperature and humidity, and as illustrated in FIGS. 8 and 9, the coagulation degree rises under a high temperature condition and under a high humidity condition as well. A higher coagulation degree indicates that the toner 3*a* has become hard.

Accordingly, an ambient temperature near the photoconductive drum 1 is measured by the temperature and humidity sensor 108 provided inside the apparatus, and when the temperature rises, the linear speed of the peeling off roller 11 is increased by increasing the number of rotations of the peeling off roller 11. Thereby, the developer 3 is sufficiently mixed and stirred, and by which replacement of the developer 3 with each other and frictionally charging of the developer 3 are sufficiently accelerated. Also, the humidity inside the apparatus is measured by the temperature and humidity sensor 108, and when the humidity rises, by controlling the driving of the peeling off roller 11 in substantially the same manner as when the temperature rises, the developer 3 is sufficiently mixed and stirred, such that replacement of the developer 3 with each other and frictionally charging of the developer 3 are sufficiently accelerated.

Further, in this embodiment, as illustrated in FIG. 4, the magnetic pole S2 in the position opposing the developer accommodating part S is slightly deviated to the side of the doctor 6; however, the magnetic pole S2 may be arranged such that the peak position of a density distribution of a magnetic flux generated by the magnetic pole S2 in a normal line direction substantially coincides with a direction leading to the center of the peeling off roller 11. By this arrangement, the peeling off roller 11 can be most strongly magnetized and thereby the peeling off and conveying force of the peeling off roller 11 is most greatly exerted. As a result, in the developer accommodating part S, the frictional charging of the developer 3 is effectively made at the gap between the developing sleeve 4 and the peeling off roller 11.

Further, for effectively circulating the developer 3 along the circumferential surface of the peeling off roller 11 in the developer accommodating part S, the magnetic flux distribution in the normal line direction at a circumferential surface of the peeling off roller 11 at the side opposite the surface thereof opposing the developing sleeve 4 may be preferably made to be greater than 5 mT.

Furthermore, for effectively circulating the developer 3 along the circumferential surface of the peeling off roller 11 in the developer accommodating part S, a certain space must be maintained in the developer accommodating part S so that the developer 3 can circulate. For maintaining such a space in the developer accommodating part S, the take-in of the toner 3*a* must be stopped while the space remains in the developer accommodating part S. In this respect, the inventors of the present invention found out through various experiments that the space can be maintained in the developer accommodating part S if the following condition (1): $MF2<(2/3)MF1$ is satisfied, wherein a magnetic force which is received by the developer 3 on the developing sleeve 4 at the position opposing the peeling off roller 11 is MF1 and a magnetic force which is received by the developer 3 on the developing sleeve 4 at the position opposing the pre-doctor 7*a* is MF2.

If the above force MF2 becomes relatively large on the developing sleeve 4, an effect of the breaking force by the peeling off roller 11 does not reach a vicinity of the toner supplying opening 8*a*. As a result, the conveying speed of the developer 3 does not decrease even when the toner density of the developer 3 increases, making it difficult to increase the thickness of the layer of the developer 3. Accordingly, the taking-in of the toner 3*a* can not be stopped until the developer accommodating part S is filled with the developer 3. Therefore, in this embodiment, as indicated by the condition (1), the magnetic force MF2 which is received by the developer 3 at the position opposing the pre-doctor 7*a* is made weaker relative to the magnetic force MF1 received by the developer 3 at the position opposing the peeling off roller 11, such that the effect of the breaking force by the peeling roller 11 reaches the vicinity of the toner supplying opening 8*a*. The control of a waveform of the magnetic force may be appropriately made according to the position, the magnetism, the shape, and the magnetic force of a magnet piece arranged at each pole.

Figure 10:
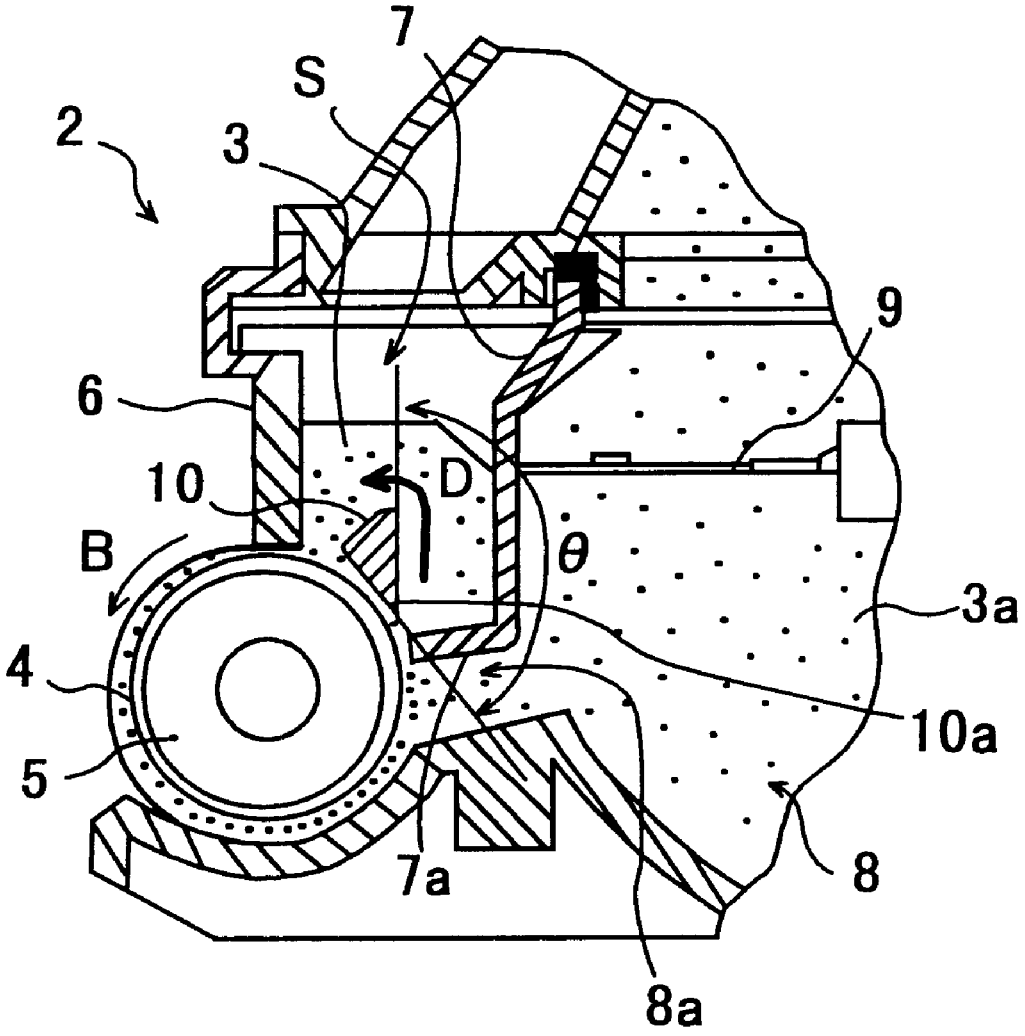
FIG. 10 is an enlarged view of a main part of the developing device including a peeling off member having a scooping surface for scooping the developer on the developing sleeve so as to be peeled off the developing sleeve.

Further, in this embodiment, as the peeling off member, the peeling off roller 11 formed in a rotatable roller-like shape is used; however, the peeling off member can be differently shaped. For example, as illustrated in FIG. 10, a peeling off member 10 having a scooping surface 10*a* may be provided so as to extend substantially over the entire longitudinal area of the developer accommodating space S (the area along an axial direction of the developing sleeve 4) for scooping the developer 3 on the developing sleeve 4 so as to be peeled off the developing sleeve 4. The scooping angle θ of the scooping surface 10*a* of the peeling off member 10 relative to a tangent line to a surface of the developing sleeve 4 is preferably greater than 90 degrees so that the developer 3 is efficiently peeled off without being halted. Because of this scooping surface 10*a* of the peeling off member 10, the upper layer of the conveyed developer 3*b* being carried and conveyed by the developing sleeve 4 rotating in a counterclockwise direction is peeled off and a developer flow indicated by the arrow D is generated. Due to this flow of the peeled off developer, mixing and stirring of the developer peeled off the developing sleeve 4 and the developer in the developer accommodating part S is accelerated. A part of the developer thus mixed and stirred is carried on the developing sleeve 4 between the peeling off member 10 and the doctor 6 by a magnetic force.

Now, a result of an experiment made using a concrete example of the developing device according to the above-described embodiment of the present invention is described.

In the experiment, the developing device as illustrated in FIG. 2 was used, and 20 prints were made using a test chart 60 illustrated in FIG. 1. As illustrated, the test chart 60 includes black stripes which are formed at intervals so that the toner consumption varies in a direction perpendicular to a surface moving direction (indicated by the arrow G in FIG. 11) of the developing sleeve 4, i.e., an image width direction of the test chart 60. After making 20 prints of the test chart 60, another 20 prints were made using another test chart having an even half-tone over the entire surface thereof. The experiment was made under the conditions of Table 1.

Table 1

Linear speed of the photoconductive drum: 120 mm/sec;
Gap Gp between the developing sleeve and the photoconductive drum: 0.3–0.5 mm;
Gap Gd 1 between the developing sleeve and the doctor: 0.3–0.5 mm;
Gap Gd2 between the developing sleeve and the pre-doctor: 0.5–1.5 mm;
Gap Gh between the developing sleeve and the peeling off roller: 0.2–0.4 mm;
Diameter of the developing sleeve: 16–20 mm;
Linear speed ratio of the developing sleeve and the photoconductive drum: 1.5–3.0;
Magnetic flux density (in the normal line direction) on the developing sleeve N1: 93 mT;
Magnetic flux density (in the normal line direction) on the developing sleeve S1: 75 mT;
Magnetic flux density (in the normal line direction) on the developing sleeve N2: 60 mT;
Magnetic flux density (in the normal line direction) on the developing sleeve S2: 53 mT;
Material of the carrier: magnetite or steel;
Particle diameter of the carrier: 40–50 $\mu$m;
Volume of the magnetic member in the toner: 15–40 wt %;
Volume of silica in the toner: 0.5–1.0 wt %;
Covered ratio of the toner relative to the carrier: 50–120%;
Q/M: 10–30 $\mu$c/g.

For example, using the peeling off roller 11 having the diameter of 7 mm, the gap Gp was set to 0.35 mm, the gap Gd1 to 0.4 mm, the gap Gd2 to 0.65 mm, and the gap Gh to 0.35 mm. In the experiment made under the conditions as above, the developer peeled off by the peeling roller 11 was well mixed and stirred, such that the developer was made uniform, and thereby a good image without having uneven image density was obtained. In the above example of the developing device, the gap Gh between the developing sleeve 4 and the peeling off roller 11 and the gap Gd2 between the developing sleeve 4 and the pre-doctor 7*a* satisfied the relation: 0<Gh<Gd2, and thereby a good stirring capability was obtained with the peeling off roller 11.

Further, the peeling off roller 11 may be a magnetic member such as a SUM member, and the center part of the peeling off roller 11 may be slightly bent so as to come close to the developing sleeve 4 by 0.1 mm under the condition that the magnetic flux density in the normal line direction on the developing sleeve 4 opposing the peeling off roller 11 is 56 mT. Therefore, the shape of the peeling off roller 11 was made, as illustrated in FIG. 5, such that the center diameter D2 is smaller (6.8 mm) than the diameter D1 at both ends thereof (7 mm). By thus shaping the peeling off roller 11, the gap between the peeling off roller 11 and the developing sleeve 4 was kept at about 0.35 mm over the entire axial direction of the peeling off roller 11, and thereby peeling off of the developer 3 and mixing and stirring of the developer 3 thereafter were uniformly made over the entire area of the peeling off roller 11 from the center part to the both ends thereof.

On the other hand, when the above test chart having a half-tone image was printed using a conventional developing device in which the peeling off member 12 was not used, uneven image density was observed in the half-tone image. Thus, it has been confirmed that if the peeling off roller 12 is not provided, when printing a test chart having black stripes such that the toner consumption changes in the longitudinal direction of the developing sleeve 4, the toner density becomes uneven in the longitudinal direction of the developing sleeve 4, thereby resulting in deteriorating the produced image.

Figure 12:
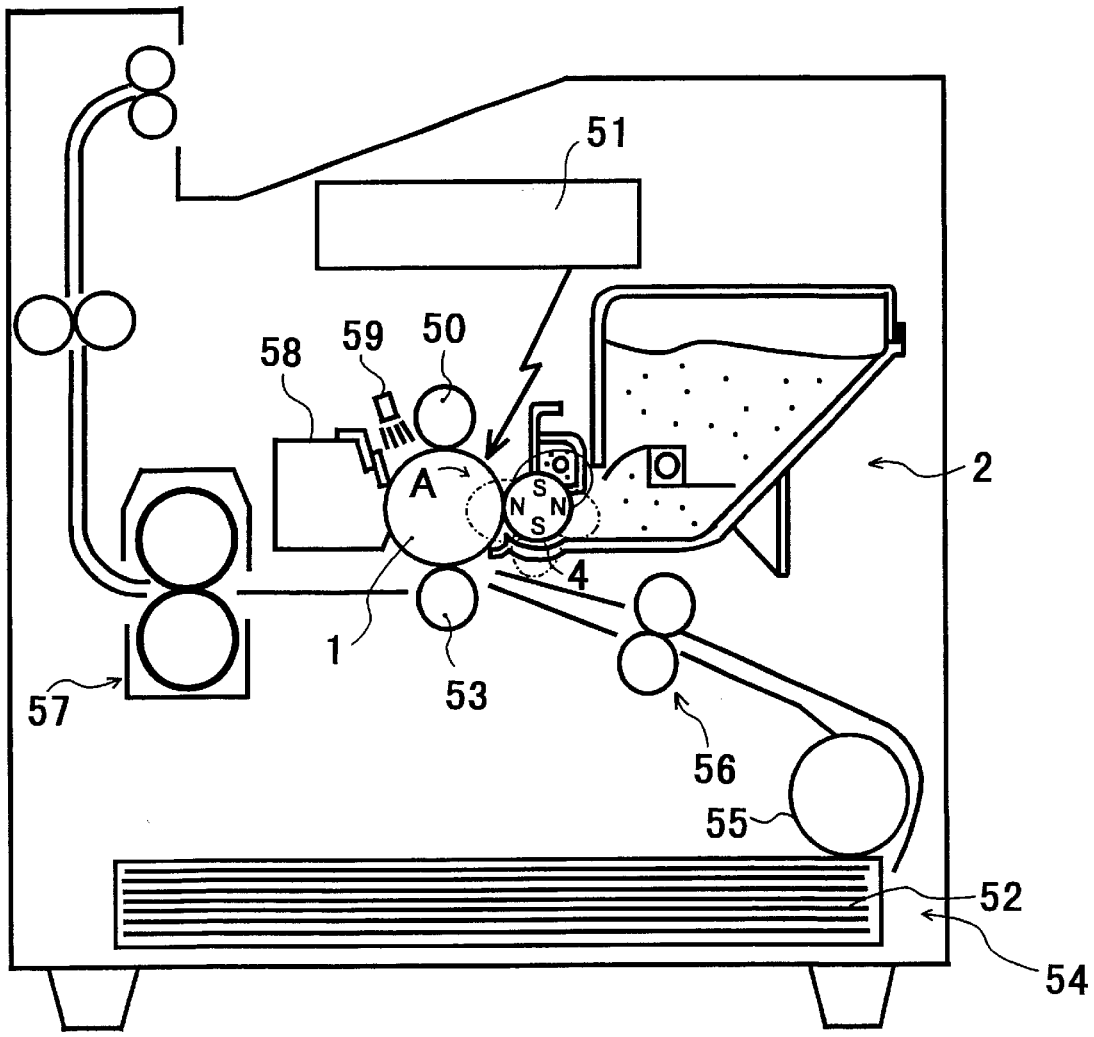
FIG. 12 is a front view illustrating an exemplary construction of a printer according to another embodiment of the present invention.
Figure 13:
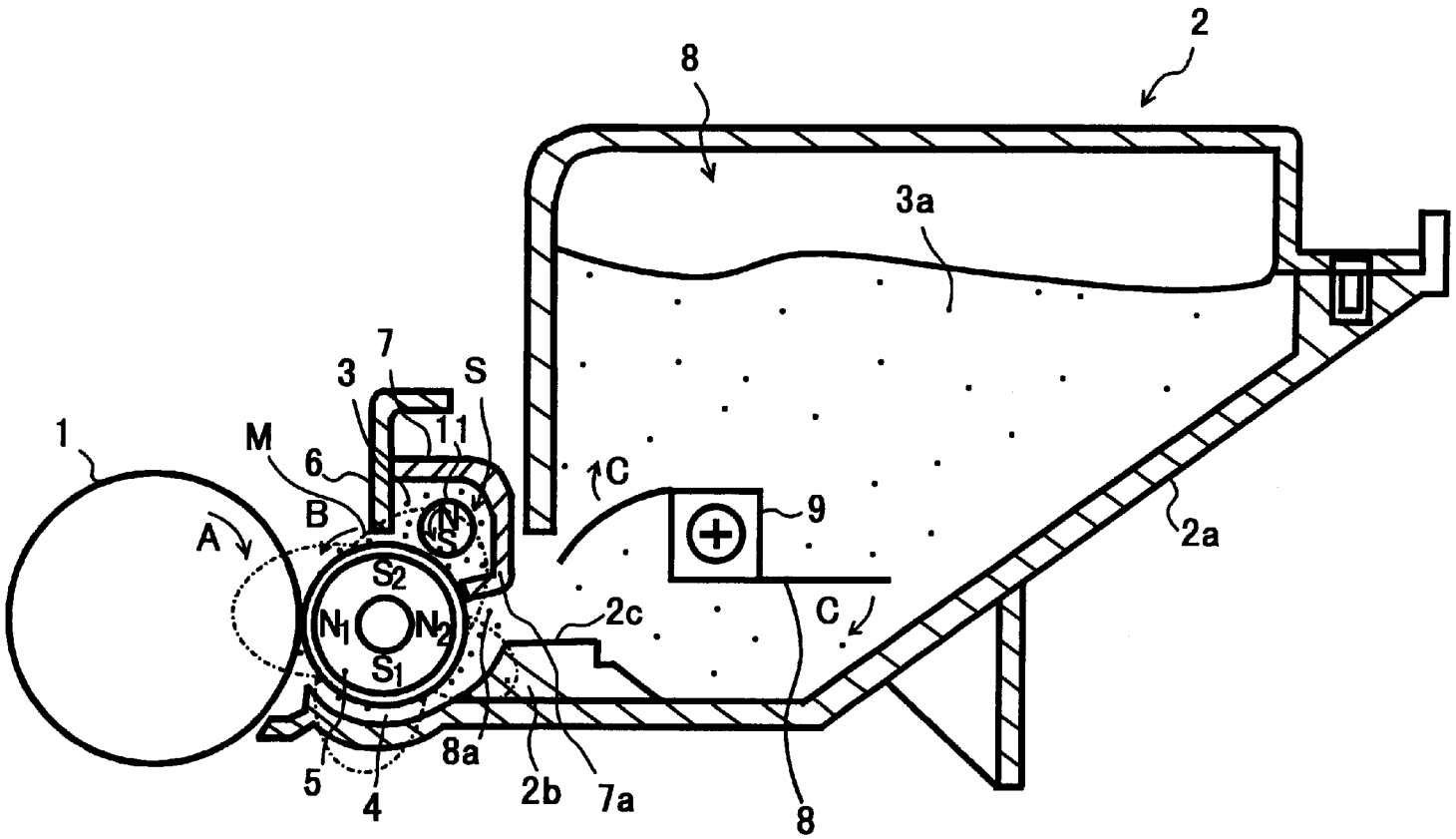
FIG. 13 is a cross-section of a developing device of the printer.

FIG. 12 is a front view illustrating an exemplary construction of a printer according to another embodiment of the present invention, and FIG. 13 is a cross-section illustrating an exemplary construction of a developing device of the printer. In FIGS. 12 and 13, the parts similar to those of the printer according to the previous embodiment, illustrated in FIGS. 1 and 2, are denoted by like references, and the description thereof is omitted because the function is substantially the same. One-dot-and-dash lines in FIG. 12 and 13 around the developing sleeve 4 respectively denote the components of a magnetic flux in the normal line direction at a surface of the developing sleeve 4.

In this embodiment, in contrast to the previous embodiment in which the peeling off roller 11 made of a magnetic member is used, a peeling off roller 13 including a magnetic roller, in which the magnetic pole has been magnetized in advance so as to have a magnetic force by itself, is used for the peeling off member. Further, in the developing device, at a bottom part of a casing 2 in a vicinity of a toner supplying opening 8*a*, a protruded part 2*b* having an opposing surface 2*c* is formed. The opposing surface 2*c* is formed so as to have a predetermined length and to be inclined downward toward the developing sleeve 4. The construction of the toner hopper 8 is different from that of the previous embodiment, however, because its relevancy to the invention is very little, the description thereof is omitted.

Figure 14:
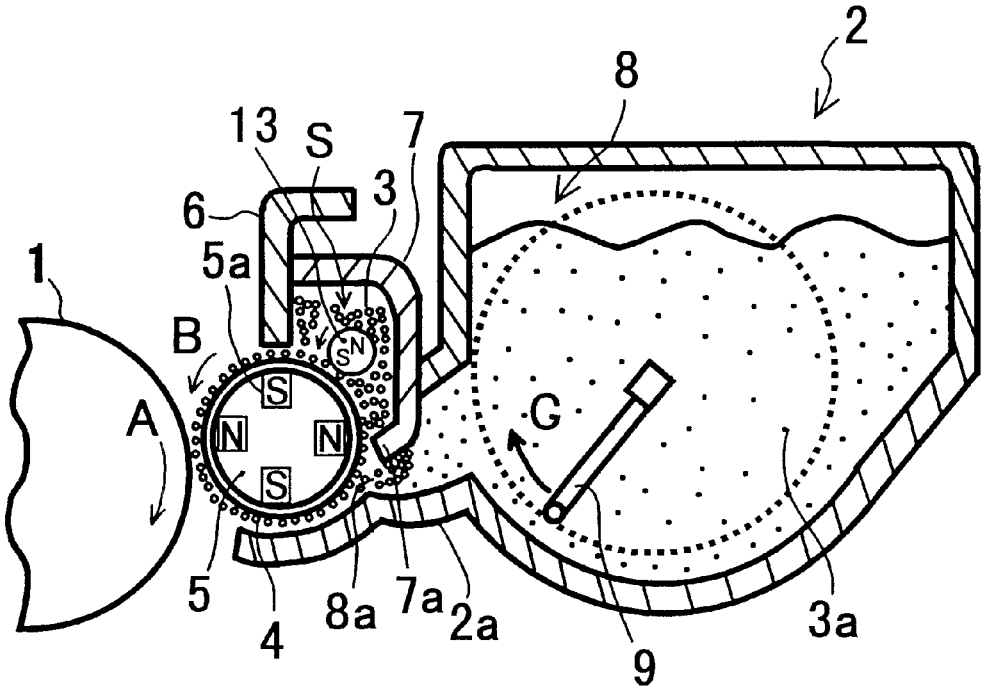
FIG. 14 is a cross-section of the developing device in which a magnetic roller is used for the peeling off roller.

FIG. 14 is a cross-section illustrating the developing device in a more simplified manner than FIG. 13 for highlighting the peeling off roller 13 including a magnetic roller. In this developing device, the peeling off roller 13, in which a pair of magnetic poles (S and N poles) are arranged at a surface thereof so as to extend along the axial direction thereof, is used, and the peeling off roller 13 is rotated at a position opposing a magnetic pole 5*a* of the developing sleeve 4 as in the previous embodiment. This peeling off roller 13 can more strongly attract the developer 3, which is carried and conveyed by the developing sleeve 4, by a magnetic force. Accordingly, a peeling off of the developer 3 from the developing sleeve 4 and an enforced flow of the peeled off developer 3 are more securely performed, and thereby mixing and stirring of the peeled off developer with the developer in the developer accommodating part S is more effectively performed.

Figure 15:
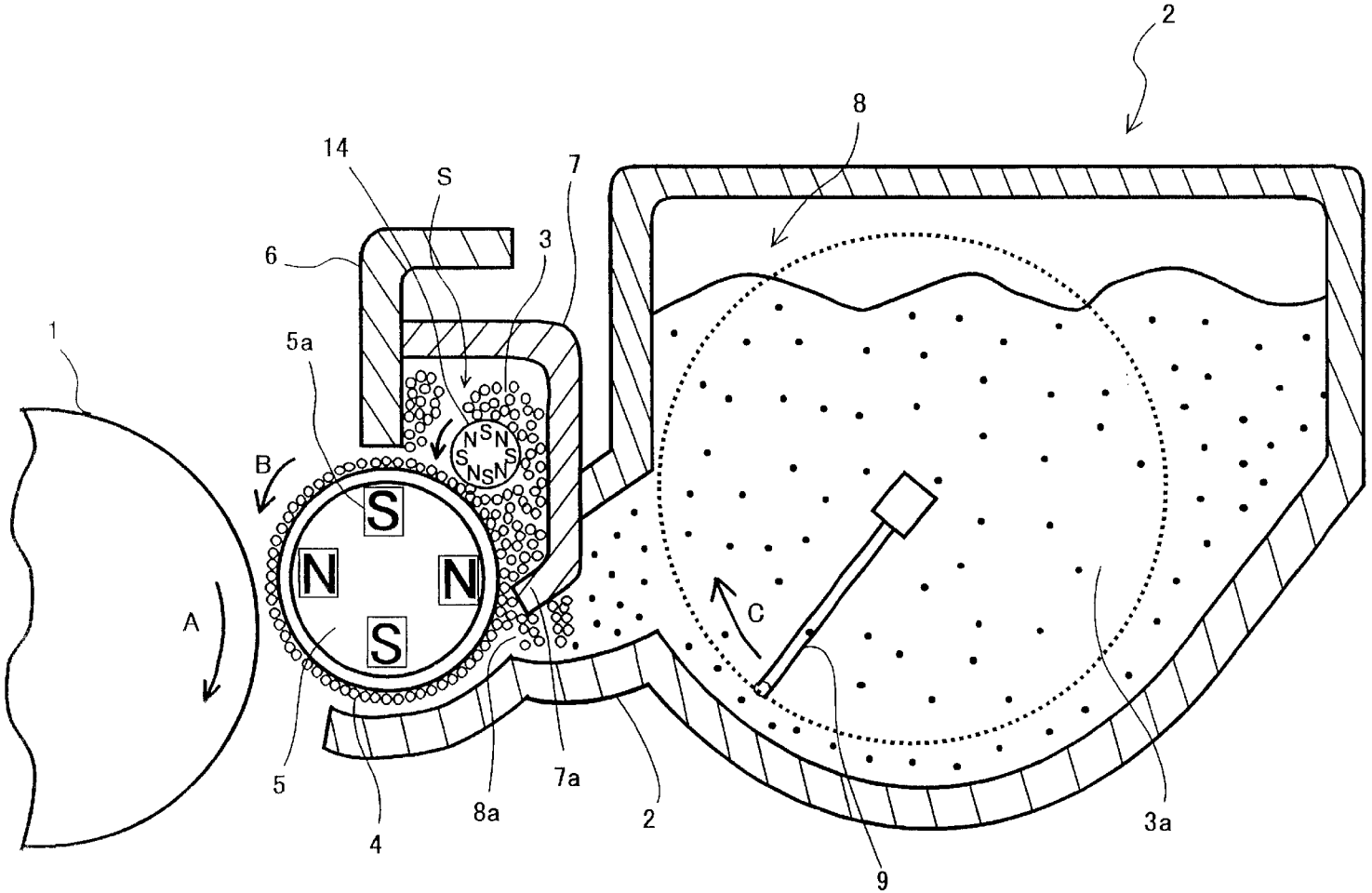
FIG. 15 is another cross-section of the developing device in which another exemplary magnetic roller is used for the peeling off roller.

FIG. 15 is a section view of the developing device including a peeling off roller 14 having another exemplary magnetic roller. The peeling off roller 14 includes a plurality of N and S poles alternately arranged at the circumferential surface thereof. In the example of the peeling off roller 14 illustrated in FIG. 15, four pairs of N and S poles are arranged. The peeling off roller 14 is disposed so as to be rotatable and in a position opposing an S pole 5*a* of the magnet roller 5 arranged in the developing sleeve 4. When the peeling off roller 14 rotates and one of the S poles arranged at its surface thereof comes close to the S pole 5*a* of the magnet roller 5, the developer 3 between the peeling off roller 14 and the developing sleeve 4 receives a force to be expelled therefrom. When one of the N poles of the peeling off roller 14 comes close to the S pole 5*a*, the developer 3 between the peeling off roller 14 and the developing sleeve 4 receives an attracting force. Thus, expelling and attracting forces are alternately exerted in a small space between the developer sleeve 4 and the peeling off roller 14, and thereby mixing and stirring of the developer in the space is actively performed so that the toner density is made uniform. Further, because of the magnetic force of the magnetic poles alternately magnetized on the peeling off roller 14, a part of the developer 3 is attracted to the peeling off roller 14 at other parts than the vicinity of the developing sleeve 4, and thereby the stirring force is further enhanced. Accordingly, the toner distribution is more effectively made uniform, and thereby an abnormal image such as an image having uneven image density is prevented.

Figure 16:
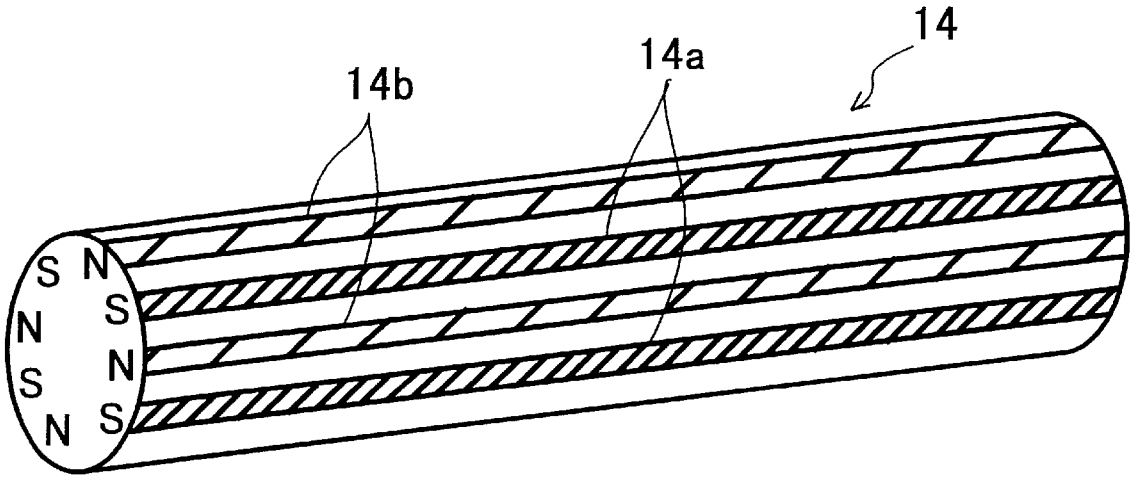
FIG. 16 is a perspective view of the another exemplary magnetic roller.

Further, as illustrated in FIG. 16, a plurality of poles 14*a*, 14*b* having substantially the same length as that of the peeling off roller 14 in the axial direction thereof may be arranged such that S and N poles are alternately disposed in the circumferential direction. In this case, when the developer 3 adheres to the surface of the peeling off roller 14 to form a layer of the developer 3 threupon, the surface of the layer of the developer 3 is unevenly formed, by which a stirring effect similar to the one obtained when a member having a uneven surface is used for the peeling off roller 14 can be obtained.

Figure 17A:
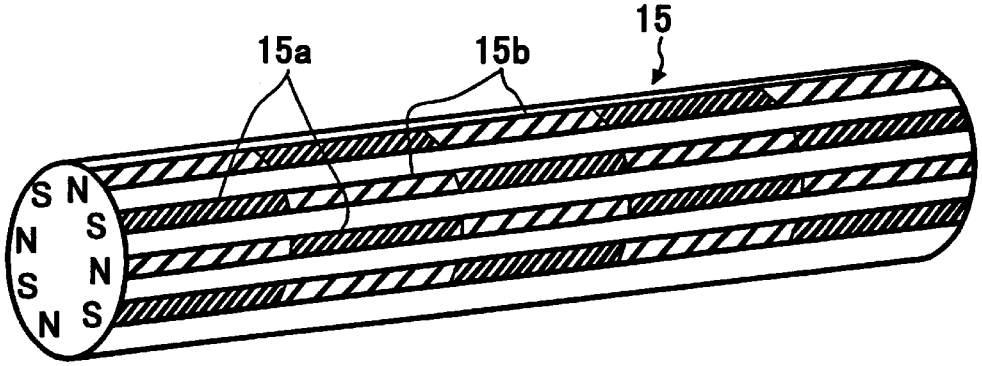
FIGS. 17(*a*)–17(*c*) are diagrams illustrating peeling off rollers in which N and S poles are alternately magnetized in the axial direction of the peeling off rollers.
Figure 17B:
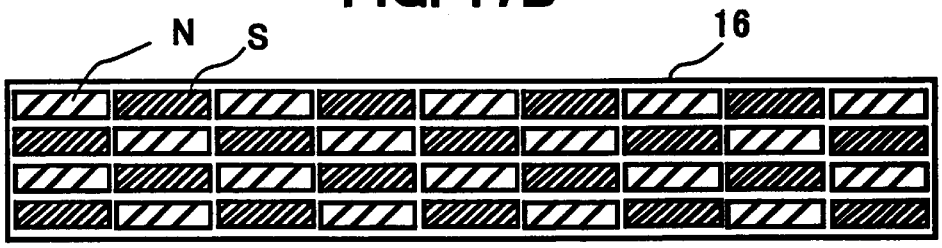
Figure 17C:
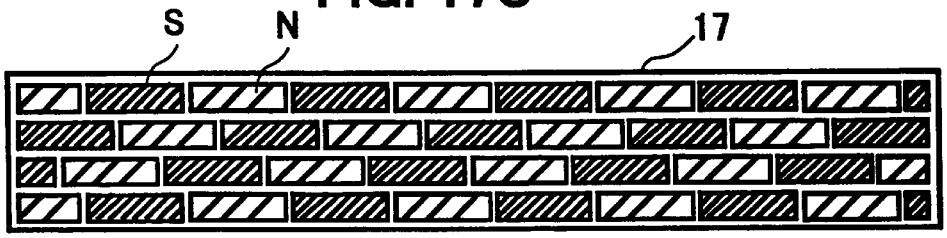
Figure 18A:
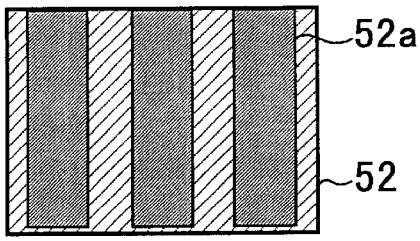
FIGS. 18(*a*)–18(*e*) are diagrams illustrating half-tone images formed on sheets, respectively having residual black stripes of different density.
Figure 18B:
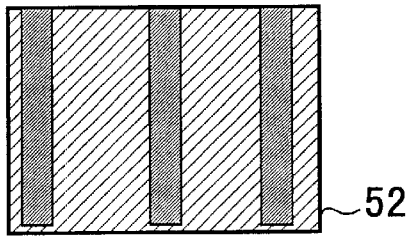
Figure 18C:
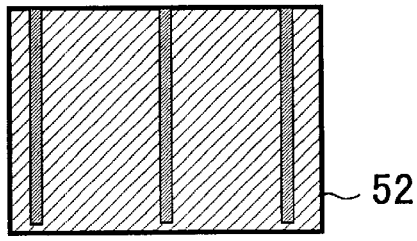
Figure 18D:
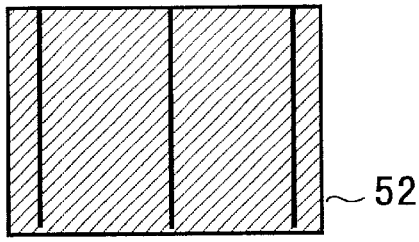
Figure 18E:
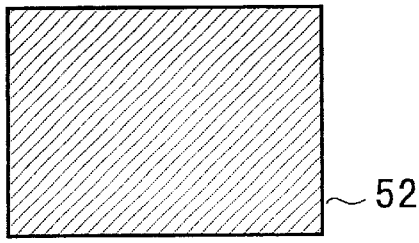

FIG. 17(*a*) is a perspective view of another example of the peeling off roller. A peeling off roller 15 is configured such that a magnetic pole having a predetermined length in the axial direction of the peeling off roller 15 is alternately magnetized with a S pole 15*a* and a N pole 15*b* in the axial direction thereof. If the developer 3 adheres to this peeling off roller 15, in addition to the stirring effect described with respect to the peeling off roller 14 illustrated in FIG. 16, a stirring mechanism is also generated between the poles alternately arranged in the axial direction of the peeling off roller 15, thus more effectively mixing and stirring the developer 3.

Further, in a peeling off roller 16 illustrated in FIG. 17(*b*), the N and S poles may be slightly separated from each other in the axial direction thereof, or in a peeling off roller 17 illustrated in FIG. 17(*c*), the N and S poles may be separated from each other such that the poles of the same polarity overlap with each other in the circumferential direction thereof.

Figure 11:
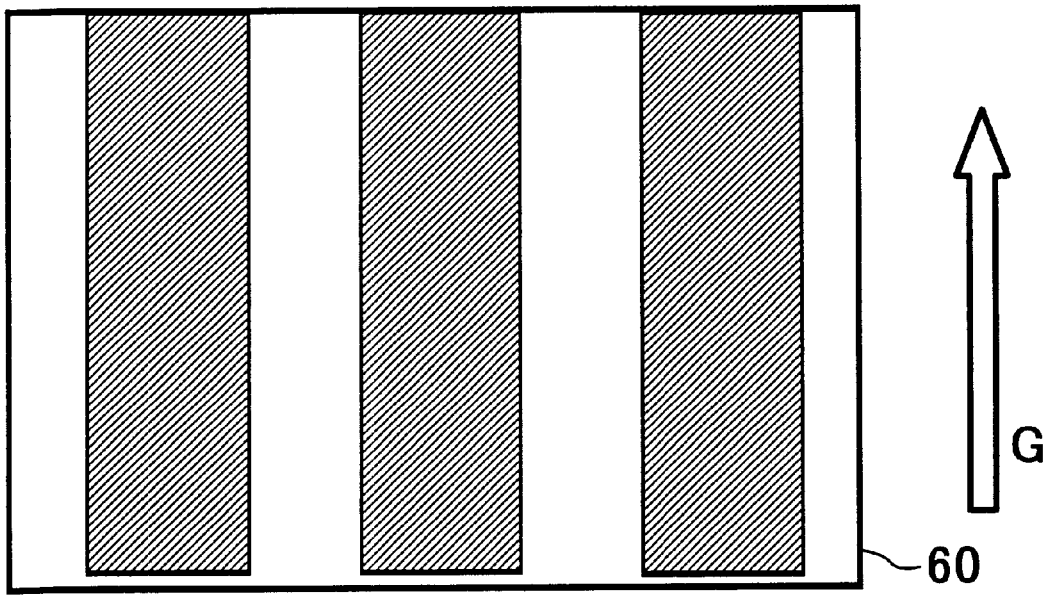
FIG. 11 is a diagram illustrating a test chart used for an experiment, in which black stripes are formed at intervals in a width direction of the chart.

Now, a result of an experiment made using a concrete example of the developing device 2 according to the above-described embodiment is described. Using the developing device 2 of FIG. 15, 20 prints were made for the test chart 60 in which black stripes are repeatedly formed as illustrated in FIG. 11 so that the toner 3*a* is consumed in particular places of the developing sleeve 4 in the width direction thereof, i.e., correspondingly to the black stripes. Thereafter, an image having a half-tone of about ID 0.2–0.5 (measured by a reflecting density measuring device) over the entire surface thereof was printed for 20 prints, and the image density unevenness was evaluated for ranking the degree of the image density unevenness. The developing conditions were set as specified in the following Table 2.

Table 2

Diameter of the photoconductive drum: 30 mm;
Linear speed of the photoconductive drum: 100 mm/sec;
Gap Gp between the developing sleeve and the photoconductive drum: 0.4 mm;
Gap Gd1 between the developing sleeve and the doctor: 0.4 mm;
Gap Gd2 between the developing sleeve and the pre-doctor: 0.6 mm;
Gap Gh between the developing sleeve and the peeling off roller: 0.4 mm;
Diameter of the developing sleeve: 16 mm;
Linear speed ratio of the developing sleeve relative to the photoconductive drum: 2.5;
Linear speed ratio of the peeling off roller relative to the developing sleeve: 0.8;
Material of the carrier: magnetite;
Particle diameter of the carrier: about 50 $\mu$m;
Material of the toner: resin in which a magnetic member is mixed;
Particle diameter of the toner: 6.5–9.5 $\mu$m.

FIGS. 18(*a*)–18(*e*) are diagrams for explaining the degree of the image density unevenness, each illustrating a half-tone image having residual black stripes 52*a* of different density, which was formed on a sheet 52. The image density unevenness of FIG. 18(*a*) is given a rank 2, that of FIG. 18(*b*) a rank 3, that of FIG. 18(*c*) a rank 3.5, that of FIG. 18(*d*) a rank 4, and that of FIG. 18(*e*) a rank 5. The higher the rank, the image density unevenness is less. The image density unevenness of rank 3 is the one obtained by conventional apparatuses.

In the experiments made under the conditions as above, it was confirmed that the image density unevenness has been improved. Specifically, with the peeling off roller 14 illustrated in FIG. 16, images of rank 3 or 3.5 were obtained, and with the peeling off rollers 15, 16, and 17 illustrated in FIGS. 17(*a*), 17(*b*) and 17(*c*), images of rank 3.5 or 4 were obtained.

Further, with respect to the developing device according to the above-described embodiment, the inventors of the present invention have found that the ratio between the linear speed of the developing sleeve 4 and that of the peeling off roller 14 plays an important role in generating a circulating movement of the developer 3 around the peeling off roller 14 and in sufficiently accelerating the frictional charging of the developer 3 with each other. Therefore, an independent variable speed driving device (not shown) that rotates the peeling off roller 14 with the linear speed thereof made variable may be provided inside a driving part of the developing device, such that the variable speed driving device is controlled by the engine control part 100 illustrated in FIG. 7. The variable speed driving device may include a stepping motor for a driving source. An AC motor or a servo motor may also be used for the driving source of the variable speed driving device.

In order to confirm an effect of the ratio between the linear speed of the developing sleeve 4 and that of the peeling off roller 14, an experiment to form images while changing the above ratio was performed under the following conditions of Table 4.

Table 4

Linear speed of the photoconductive drum: 120 mm/sec;
Gap Gp between the developing sleeve and the photoconductive drum: 0.3–0.5 mm;
Gap Gd1 between the developing sleeve and the doctor: 0.3–0.5 mm;
Gap Gd2 between the developing sleeve and the pre-doctor: 0.5–1.5 mm;
Gap Gh between the developing sleeve and the peeling off roller: 0.3–1.2 mm;
Diameter of the developing sleeve: 16 mm;
Diameter of the peeling off roller: 7 mm;
Linear speed ratio of the developing sleeve relative to the photoconductive drum: 1.5–3.0.

As a result of the above experiments, it was found that under the condition of the linear speed of the developing sleeve 4 at S(mm/sec) and the linear speed of the peeling off roller 14 at T(mm/sec), by setting the ratio $\epsilon$ of T/S so as to satisfy a condition: $5<\epsilon<1.5$, the frictional charging of the developer 3 with each other is effectively made in the developer accommodating part S at the gap between the developing sleeve 4 and the peeling off roller 14. This is because, the quantity of the carrier which is set in the apparatus being fixed, if at least the linear speed ratio between the developing sleeve 4 and the peeling off roller 14 is within the above range of Table 4, an appropriate quantity of the toner is taken into the developer, and thereby the conveying speed and the volume of the toner on the developing sleeve 4 change such that the frictional charging of the developer 3 is effectively made.

Also, it was found that in the developing device of the above-described embodiment, the quantity of the toner 3*a* to be taken into changes according to a change of the coagulation degree of the toner 3*a* due to the environmental conditions, thereby causing a change in the conveying speed and the volume of the toner 3*a*. The coagulation degree of the toner 3*a* changes according to a change of the temperature and humidity, and as indicated in FIGS. 8 and 9, the coagulation degree rises under a high temperature condition and a high humidity condition as well. A higher coagulation degree indicates that the toner 3*a* tends to be easily hardened.

Accordingly, by providing a temperature sensor (not shown) for measuring an ambient temperature in the vicinity of the photoconductive drum 1 and by increasing the rotation number of the peeling off roller 14 with the above variable speed driving device when the temperature rises so as to increase the linear speed of the peeling off roller 14, the developer 3 can be sufficiently mixed and stirred and the frictional charging of the developer 3 with each other can be sufficiently accelerated.

Furthermore, in the digital image forming apparatuses such as the printer according to the above-described embodiment, it is also possible to change the linear speed of the peeling off roller 14 by obtaining information of the quantity of the toner 3*a* to be consumed in the development based upon the ratio of an image portion of an original for printing, which is obtained from an image signal for the original, and by changing the linear speed of the peeling off roller 14 according to the quantity of the toner 3*a* to be consumed. Specifically, when the toner density is decreased as a result of forming an image having a high image portion ratio, because a relatively large amount of the toner 3*a* is supplied and thereby the frictional charging of the developer 3 must be aggressively made, the peeling off roller 14 is controlled such that the linear speed thereof is increased. On the other hand, when the toner density is kept constant as a result of forming an image having a relatively low image portion ratio, because the frictional charging of the developer 3 needs not be aggressively made for avoiding earlier deterioration of the developer 3, the peeling off roller 14 is controlled such that the linear speed thereof is kept the same or decreased.

Also, it was found that if the above ratio $\epsilon$ becomes greater than 1.5 by increasing the linear speed of the peeling off roller 14, not only is the deterioration of the developer 3 accelerated, but also the developer 3 is regulated to be taken into the developer accommodating part S, thereby decreasing the toner density to be less than a desired level. In contrast, if the ratio $\epsilon$ becomes smaller than 0.5 by decreasing the linear speed of the peeling off roller 14, the mixing and stirring effect was not obtained and uneven supplying of the toner 3*a* was confirmed on the image. The above-described control applied to the peeling off roller 14 can be also applied to the peeling off rollers 15, 16, and 17 to obtain substantially the same effect.

Figure 19:
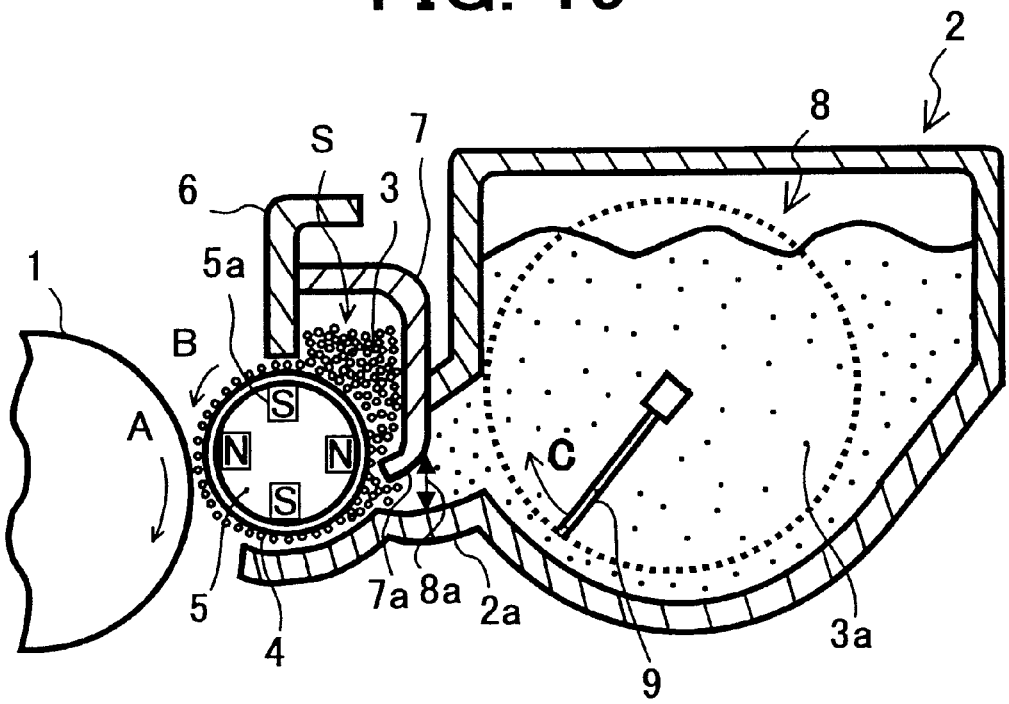
FIG. 19 is a schematic drawing illustrating a developing device according to still another embodiment of the present invention.

FIG. 19 is a schematic drawing illustrating a developing device according to another embodiment of the present invention. In FIG. 19, the parts similar to those of the previous embodiment illustrated in FIGS. 2 and 3 are denoted by like references, and because the function thereof is substantially the same, the description thereof is omitted. Also, an image forming apparatus using the developing device of this embodiment can be controlled by the control part illustrated in FIG. 7.

Figure 22:
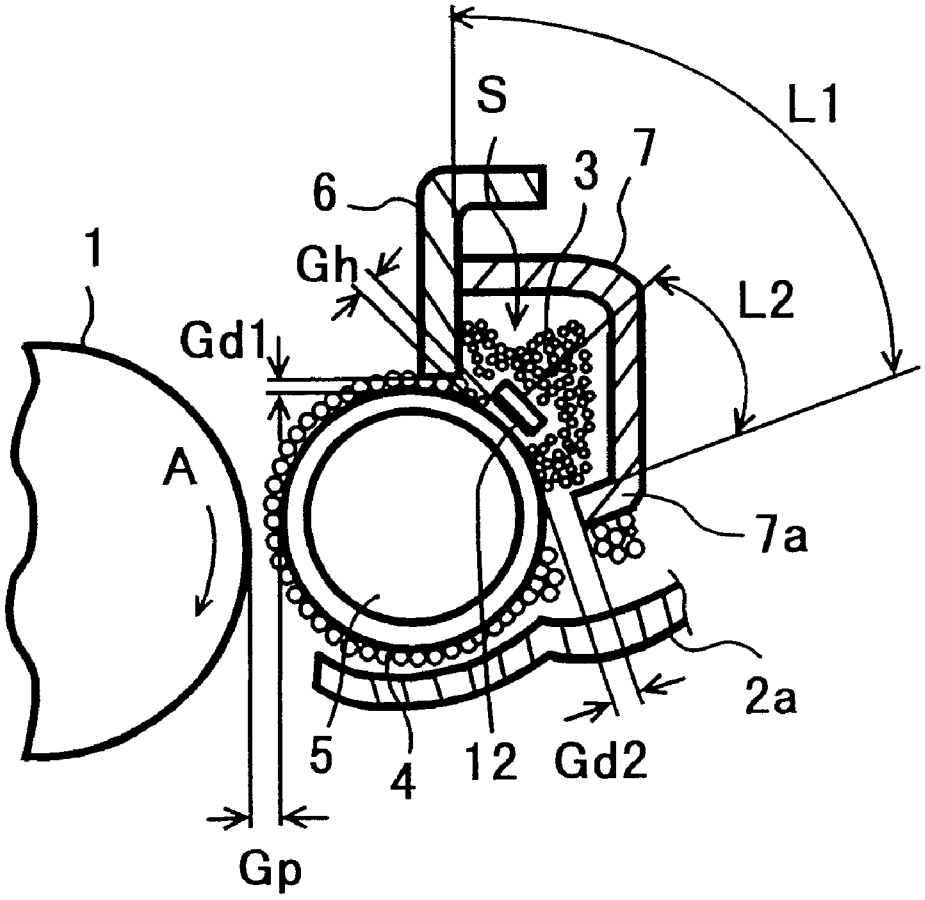
FIG. 22 is a schematic drawing indicating intervals of relevant parts of the developing device.

In the developing device of this embodiment, a peeling off member 12 formed in a grid-like flat plate is arranged in the developer accommodating part S downstream of the pre-doctor 7*a* in the rotating direction of the developing sleeve 4. The peeling off member 12 is uniformly flat in the longitudinal direction thereof and a gap Gh relative to the developing sleeve 4 and an interval L2 relative to the pre-doctor 7*a* are kept constant (see FIG. 22).

In the developing device of FIG. 19, the toner 3*a* supplied from the toner hopper 8 formed upstream of the pre-doctor 7*a* passes the pre-doctor 7*a* to reach the peeling off member 12. The developer attempting to move toward the doctor 6 caused by the conveying force of the developing sleeve 4 is once peeled off the developing sleeve 4 by the peeling off member 12. The developer peeled off by the peeling off member 12 is replaced and mixed with the developer accommodated in the developer accommodating part S and is then carried again by the developing sleeve 4 by a magnetic force. With this replacement and mixture of the developer, the developer is stirred such that the toner density becomes uniform and also the toner charging is accelerated.

As described above, according to the above-described embodiment, by accelerating the replacement and mixture of the developer on the developing sleeve 4 with the one in the developer accommodating part S, earlier deterioration of the developer due to a decrease of a charging capability of the carrier in the developer is prevented. Furthermore, even when the toner is unevenly supplied to the developing sleeve 4 in the longitudinal direction thereof, the developer in which the toner is uniformly distributed can be conveyed to the developing area, thereby enabling development of an image without causing uneven image density.

The peeling off plate 12 formed in a grid-like flat plate is disposed so as to be in close proximity to and to have the gap Gh relative to a surface of the developing sleeve 4.

Therefore, a space for enabling the developer to freely move therein can be realized in the developer accommodating part S at a position separated from a surface of the developing sleeve 4. Accordingly, the developer blocked by the doctor 6 freely moves in the developer accommodating part S to the side of the toner supplying opening 8*a* without being obstructed. Therefore, the toner density control function of the developer, which is realized by changing the condition of taking the toner into the developer by changing the contact condition of the developer thus moved to the side of the toner supplying opening 8*a* with the toner supplied from the toner hopper 8, can be securely maintained.

Now, a concrete example of the developing device of the above-described embodiment and a result of an experiment made using the developing device according to the example are described. Using the developing device illustrated in FIGS. 19 and 20 prints were made with a test chart having an image in which black stripes are formed at intervals such that the toner consumption varies in the longitudinal direction of the developing sleeve 4. Thereafter, another 20 prints were made using a test chart having an image with an even half tone over the entire surface thereof. The developing conditions were substantially the same as the ones indicated in Table 1.

Figure 20:
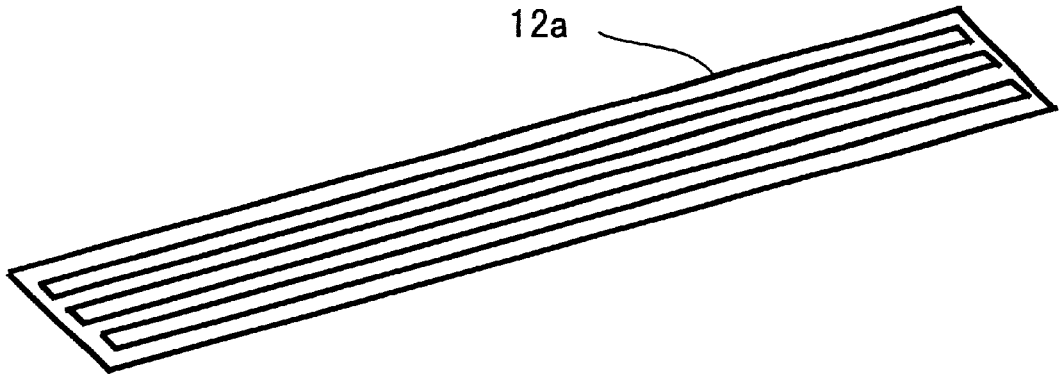
FIG. 20 is a perspective view of a peeling off member used in the developing device of FIG. 19.
Figure 21:
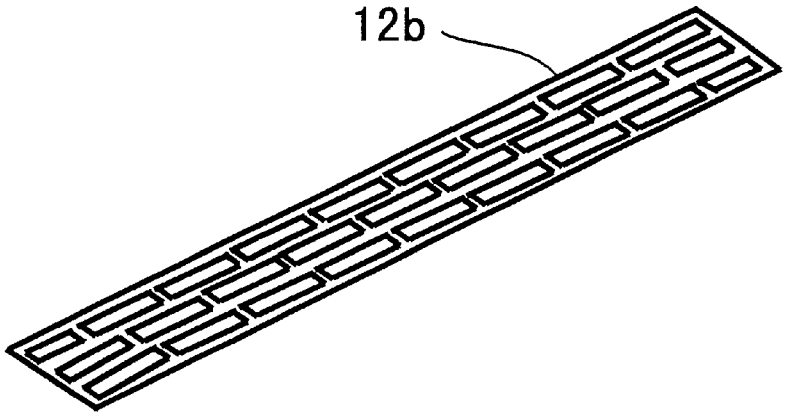
FIG. 21 is a perspective view of another peeling off member of the developing device.

For the peeling off member, flat plates 12*a* and 12*b* of a non-magnetic member formed in a grid-like shape as illustrated in FIGS. 20 and 21 were used. The developer on the developing sleeve 4 is peeled off the developing sleeve 4 by the peeling off members 12*a* and 12*b* through the grid holes thereof. The gap Gh between the peeling off member 12 and the developing sleeve 4 was set to 0.3 mm and the interval L2 between the peeling off member 12 and the pre-doctor 7*a* was set to 10 mm (see FIG. 22).

According to the result of the experiment made under the above conditions, the developer on the developing sleeve 4 was peeled off the developing sleeve 4 to be replaced and mixed with the one in the developer accommodating part S, such that the toner density of the developer was made uniform, and thereby a good image having a uniform image density was obtained.

In the experiment with the developing device of the above-described embodiment, by configuring the developing device such that the gap Gh between the peeling off member 12 and the developing sleeve 4 and the gap Gd2 between the developing sleeve 4 and the pre-doctor 7*a* satisfy the relation: $0 \ll Gh < Gd2$, a good mixing and stirring capability was realized.

Further, because only an upper part layer of the developer 3 on the developing sleeve 4 was peeled off by the peeling off member 12 of a grid-like flat plate, the self toner density control mechanism to change the condition of taking the toner 3*a* into the developer 3 by changing the contact condition of the conveyed developer 3*b* with the toner 3*a* from the toner hopper 8 at the toner supplying opening 8*a* was stably maintained.

Figure 23:
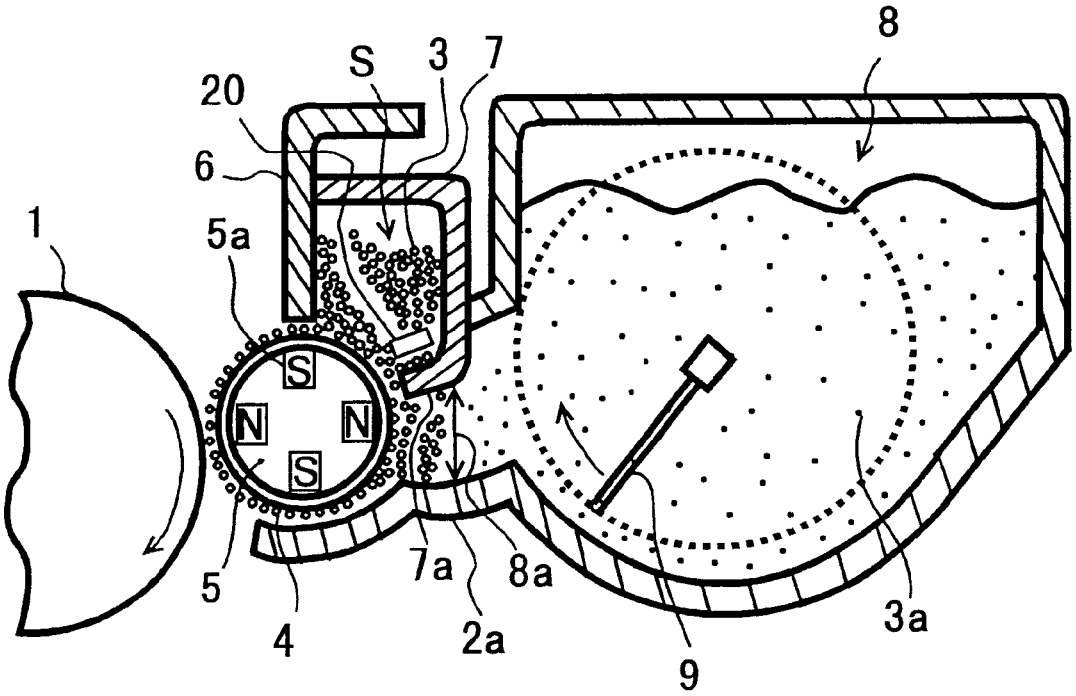
FIG. 23 is a schematic drawing illustrating a developing device according to still another embodiment of the present invention.

FIG. 23 is a schematic drawing illustrating a developing device according to still another embodiment of the present invention. In FIG. 23, the parts similar to those of the previous embodiment illustrated in FIGS. 2 and 3 are denoted by like references, and because the function thereof is substantially the same, the description thereof is omitted. Also, an image forming apparatus using the developing device of this embodiment can be controlled by the control part illustrated in FIG. 7.

In the developing device of this embodiment, a stirring comb member 20 is provided in the developer accommodating part S as a developer stirring member downstream of the pre-doctor 7*a* and upstream of the doctor 6 in the developer conveying direction of the developing sleeve 4. The stirring comb member 20 is shaped so as to have a uniform width and thickness in the longitudinal direction thereof, and the stirring comb member 20 is fixed in the developer accommodating part S so as to keep constant a distance L2 from the pre-doctor 7*a* and an interval Gk between a tip end of the stirring comb member 20 and a surface of the developing sleeve 4 (see FIG. 24).

In the developing device according to the above-described embodiment, an upper layer part of the conveyed developer on the developing sleeve 4 conveyed into the developer accommodating part S is stirred by the stirring comb member 20 opposing the developing sleeve 4 in a non-contacting manner at a position adjacent to the toner hopper 8 in the developer accommodating part S. Due to this stirring of the developer, the conveyed developer on the developing sleeve 4 and the accommodated developer in the developer accommodating part S are mixed and stirred with each other. Also, due to the above stirring of the developer, the toner 3*a* taken from the toner hopper 8 into the upper layer part of the developer on the developing sleeve 4 is stirred and mixed with the developer such that the toner density of the developer is made uniform. Thereby, the developer having a uniform toner density is carried on the developing sleeve 4 and conveyed to the developing area so as to be used for a development of a latent image on the photoconductive drum 1.

According to the above-described embodiment, because the stirring comb member 20 stirs a part (the upper layer part) of the developer on the developing sleeve 4, the conveying state of the developer on the developing sleeve 4 is not disturbed and a stable self toner density control mechanism is maintained. Further, because of the mixing and stirring of the developer with the stirring comb member 20, background soiling and decrease in the image density due to deterioration of the developer with a lapse of time are prevented, and at the same time a good development having no uneven image density in the axial direction of the developing sleeve 4 can be realized.

Now, a concrete example of the developing device according to the above-described embodiment and a result of an experiment made with the developing device according to the example are described. The developing device illustrated in FIG. 24 was used in the experiment and the experiment conditions were set as indicated in the following Table 5.

Table 5

Diameter of the photoconductive drum: 30 mm;
Linear speed of the photoconductive drum: 120 mm/sec;
Gap Gp between the developing sleeve and the photoconductive drum: 0.3–0.5 mm;
Gap Gd1 between the developing sleeve and the doctor: 0.3–0.5 mm;
Gap Gd2 between the developing sleeve and the pre-doctor: 0.5–1.5 mm;
Diameter of the developing sleeve: 16 mm;
Linear speed ratio of the developing sleeve relative to the photoconductive drum: 1.5–3.0;
Material of the toner: magnetite or steel;
Particle diameter of the toner: 40–50 $\mu$m;
Volume of a magnetic member in the toner: 15–40 wt %;
Volume of silica in the toner: 0.5–1.0 wt %;
Covered ratio of the toner with the carrier: 50–120%;
Q/M: 10–30 $\mu$c/g.

Figure 24:
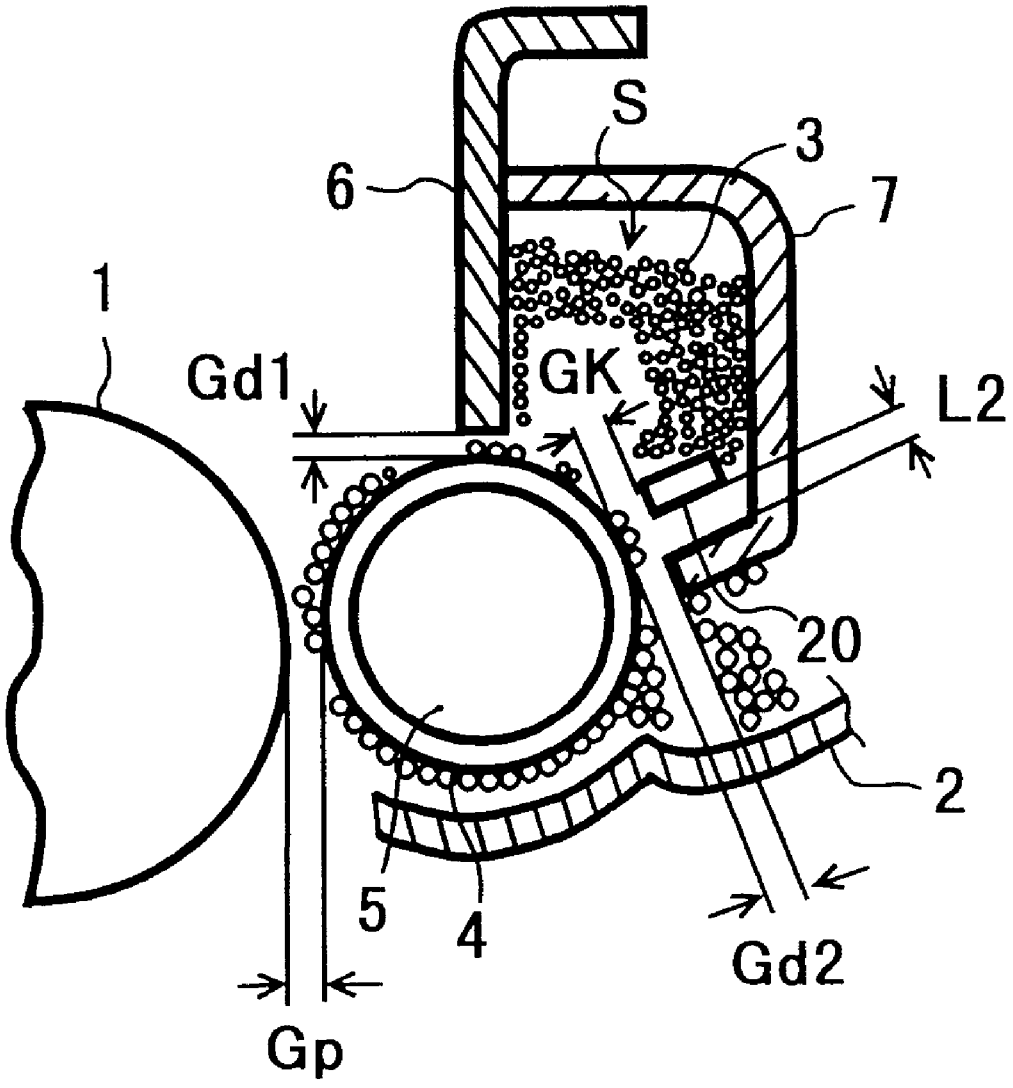
FIG. 24 is a schematic drawing indicating an arrangement position of a stirring comb member in the developing device.

FIG. 24 is a schematic drawing indicating an arrangement position of the stirring comb member 20. The gap Gk between the stirring comb member 20 and the developing sleeve 4 was set to 0.3 mm and the distance L2 between the stirring comb member 20 and the pre-doctor 7*a* to 1 mm.

Figure 25:
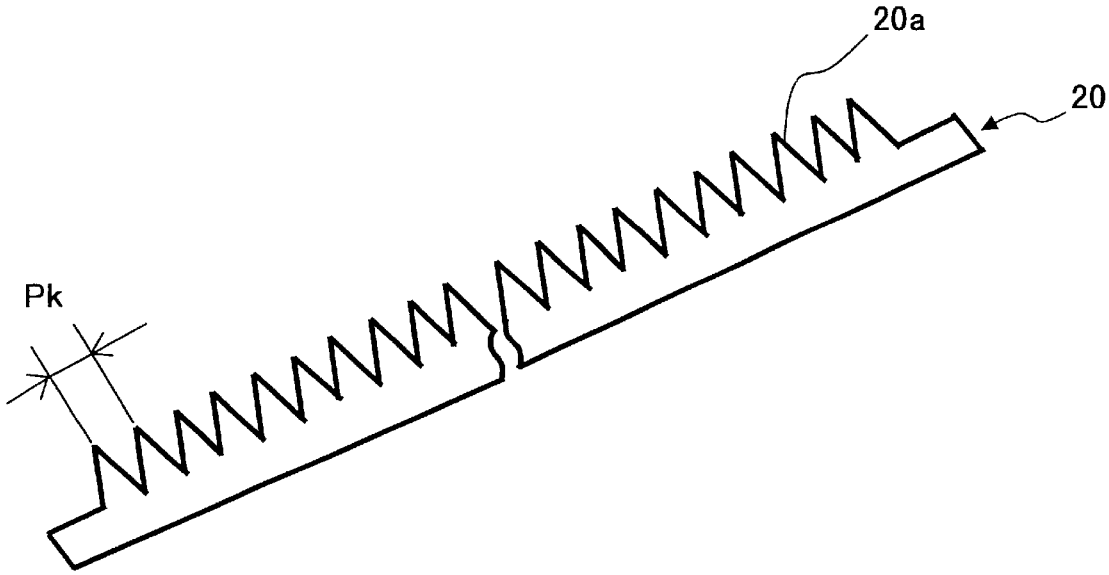
FIG. 25 is a perspective view of the stirring comb member.

FIG. 25 is a perspective view of the stirring comb member 20 used in this embodiment. The stirring comb member 20 includes a series of comb tooth 20*a* at the side opposing the developing sleeve 4. The interval Pk between the tips of neighboring two comb tooth 20*a* was set to 2 mm.

Using the developing device configured as described above, first, 20 prints were made for the test chart 60 illustrated in FIG. 11, in which black stripes are formed at intervals such that the toner consumption varies in a direction perpendicular to a surface moving direction of the developing sleeve 4 (indicated by the arrow G in FIG. 11), i.e., the image width direction of the chart 60. Thereafter, another 20 prints were made using another test chart of an image having an even half-tone over the entire surface thereof. According to a result of the experiment, the toner density of the developer 3 was made uniform with respect to the image width direction because of the stirring comb member 20, and thereby good half-tone images having no image density unevenness were obtained. In contrast, with the developing device in which the stirring comb member 20 was not provided, uneven image density was observed in the half-tone images.

From the above experiment, it was found that when developing a test chart in which black stripes are formed such that the toner consumption varies in the longitudinal direction of the developing sleeve 4, if the chart is developed without using the stirring comb member 20, a good image cannot be obtained because of uneven toner density in the image width direction, and that on the other hand, with the provision of the stirring comb member 20, the uneven toner density in the image width direction can be avoided.

More specifically, the toner 3*a* supplied from the upstream of the pre-doctor 7*a* in the developer conveying direction passes the gap between the developing sleeve 4 and the pre-doctor 7*a* together with the conveyed developer on the developing sleeve 4 to reach the stirring comb member 20. The conveyed developer containing the toner 3*a* thus supplied is stirred by a resisting force generated by the stirring comb member 20 when the developer is conveyed by the developing sleeve 4, and at the same time, when passing the stirring comb member 20, the developer hits the series of comb tooth 20*a* to be separated to both sides of each comb tooth 20*a* sandwiching the comb tooth 20*a*, so that each separated developer is mixed with another developer separated by the neighboring comb tooth 20*a* in each space between the neighboring comb teeth 20*a*. Because of this mixing of the developer in the lateral direction, the toner density in the developer is made uniform in the axial direction of the developing sleeve 4 and charging of the toner 3*a* is accelerated. As a result, even when the toner 3*a* is unevenly supplied in the longitudinal direction of the developing sleeve 4, the toner density of the developer is made uniform in the longitudinal direction of the developing sleeve 4 and thereby a good image can be obtained.

Further, because the stirring comb member 20 is arranged with the gap Gk relative to the developing sleeve 4 so as to stir a part (the upper layer part) of the conveyed developer on the developing sleeve 4, the movement of the conveyed developer on the developing sleeve 4 in the developer accommodating part S is not obstructed. Accordingly, there is no possibility that the self toner density control mechanism fails. In particular, because the developer stirring member is shaped to have comb teeth, the movement of the developer obstructed by the doctor 6 in the developer accommodating part S is hardly obstructed. Therefore, the toner 3*a* taken into the developer can be stirred while securely maintaining the mechanism of the self toner density control.

It was also found that a good stirring capability can be realized by using a nonmagnetic member for the stirring comb member 20 and by setting the gap Gk so as to satisfy the condition: $0<Gk<Gd2$. By thus setting the gap Gk, at least a part of the toner 3*a* supplied from the regulating position of the pre-doctor 7*a* securely passes the spaces between the comb tooth 20*a* and comb tooth 20*a* of the stirring comb member 20. Therefore, the supplied toner 3*a* can be securely stirred in the lateral direction.

It was also found that a good stirring capability can be realized by setting the interval Pk between the tip ends of neighboring two comb tooth 20 to satisfy the condition. $0<Pk<5$ mm. In this embodiment, the interval Pk is set to be smaller than 5 mm, and with this setting, uneven toner density in the image width direction was satisfactorily avoided.

Figure 26:
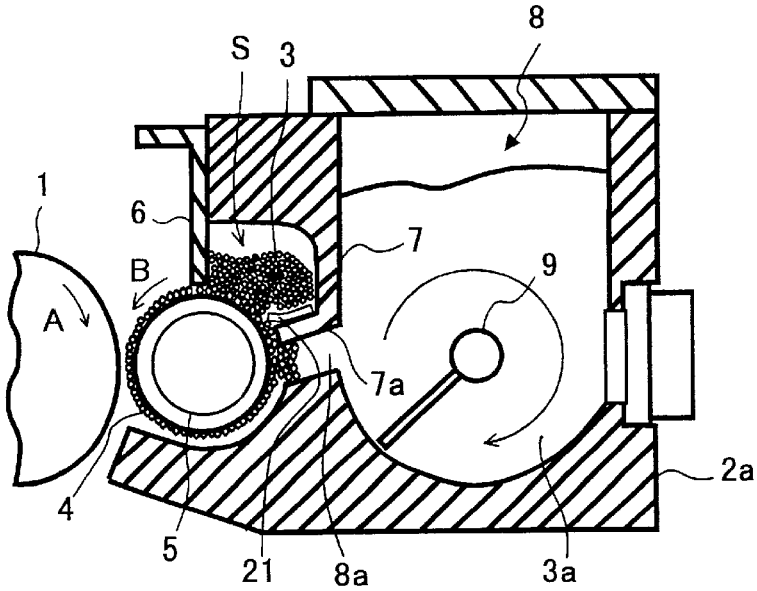
FIG. 26 is a schematic drawing illustrating a developing device according to still another embodiment of the present invention.

FIG. 26 is a schematic drawing illustrating a developing device according to still another embodiment of the present invention. The developing device is configured in substantially the same manner as the one of the previous embodiment illustrated in FIG. 23 except for the following differences. In the developing device of this embodiment, in place of the stirring comb member 20, a sheet member 21 as an example of a flexible plate member is provided at a position adjacent to the toner hopper 8 in the developer accommodating part S so as to oppose a surface of the developing sleeve 4 and to contact a part of the developer carried on the developing sleeve 4, that contains the toner 3*a* taken from the toner hopper 8. In the developing device of FIG. 23, the base plate surface of the toner supplying opening 8*a* is slightly curved like a saucer. In contrast, in the developing device of this embodiment, the base plate surface of the toner supplying opening 8*a* is shaped so as to straightly decline toward the developing sleeve 4 from the toner hopper 8. Further, at a horizontal cross-section of the toner hopper 8, the area of the toner hopper 8 is smaller than that of the developing device of FIG. 23. Furthermore, in the developing device of FIG. 23, the developer accommodating case 7 is made such that the border parts of the upper wall, the side wall, and the bottom wall (the pre-doctor 7*a*) surrounding the developer accommodating part S are respectively curved. In contrast, in the developing device of FIG. 26 according to this embodiment, the developer accommodating case 7 is made such that the border part of the side wall and the bottom wall (the pre-doctor 7*a*) are sharply bent. The construction and the operation of the developing device except for the above-described differences are substantially the same as those of the developing device of FIG. 23, and therefore the description thereof is omitted.

Figure 27:
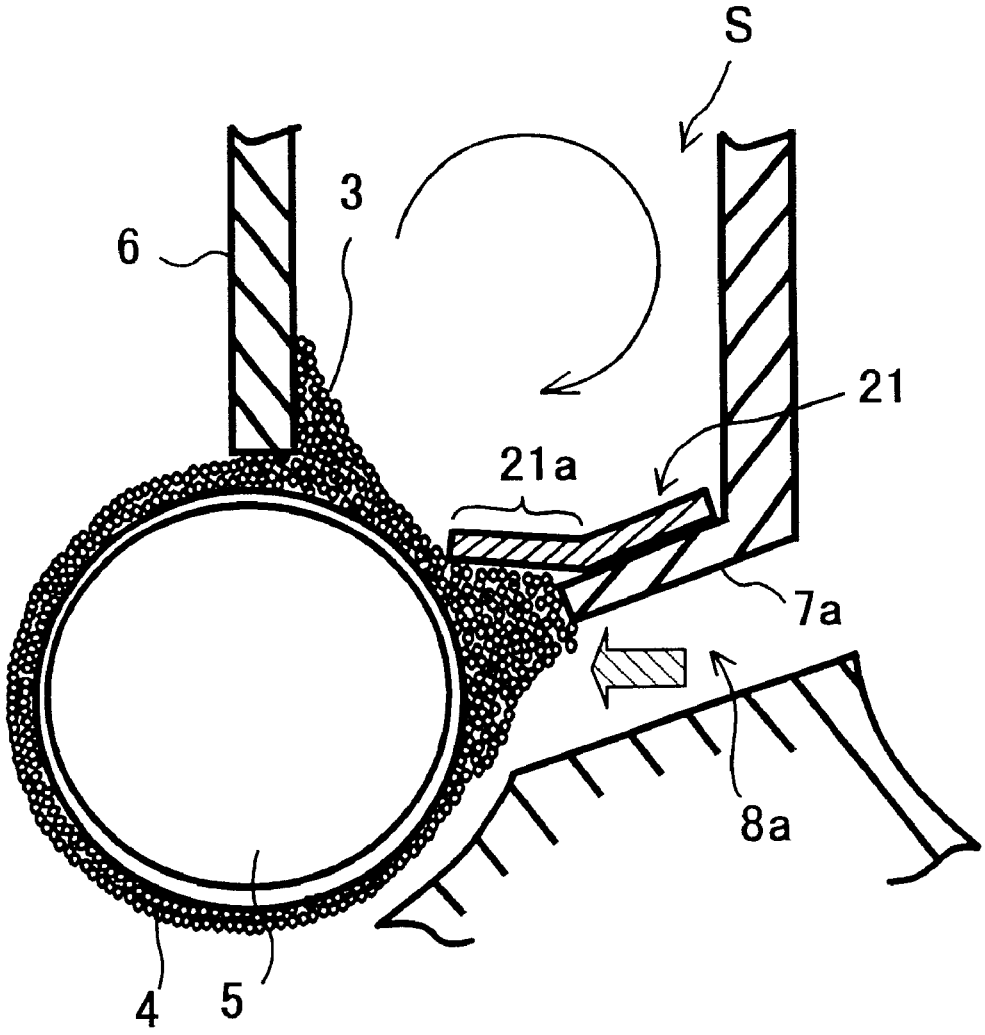
FIG. 27 is a partly enlarged schematic drawing illustrating a developer accommodating part and a toner take-in part of the developing device of FIG. 26, including a sheet member.

More concrete examples of the developing device of this embodiment are now described. FIG. 27 is a partly enlarged schematic drawing illustrating the developer accommodating part S and a toner take-in part of the developing device. In the developing device, the sheet member 21 is provided to a side surface of the pre-doctor 7*a* at the side of the developer accommodating part S. The sheet member 21 in this embodiment includes a polyurethane seal. However, any sheet-like or plate-like member having flexibility can be used for the sheet member 21.

The sheet member 21 is pasted to an internal surface of the pre-doctor 7*a* such that an end part thereof at the side of the developing sleeve 4 is formed into a free end part 21*a* and the free end part 21*a* is bent toward the downstream side of the developer conveying direction by being pulled by the developer carried and conveyed by the developing sleeve 4. The position of the tip end of the free end part 21*a* when the free end part 21*a* is thus bent defines a third regulating position. The sheet member 21 is bent or restored due to its flexibility according to a pressing force exerted by the toner 3*a* which has been taken into the developer accommodating part S through the second regulating position with the pre-doctor 7*a*. The toner 3*a* which has been excessively taken into the developer is prevented from being conveyed toward an area at the downstream side in the developer conveying direction with the developing sleeve 4. At the same time, at the third regulating position, the toner density in the developer is made uniform in the image width direction which is perpendicular to the developer conveying direction by the developing sleeve 4. Thus, the excessive toner 3*a* is removed and the toner 3*a* which has been uniformly distributed in the image width direction is taken into the conveyed developer on the developing sleeve 4, and the toner density in the conveyed developer on the developing sleeve 4 is further made uniform at the regulating position by the doctor 6 so as to be used for development.

Good images were obtained without having uneven image density in the image width direction in an experiment made using a developing device provided with the sheet member 21 as described above.

Figure 28:
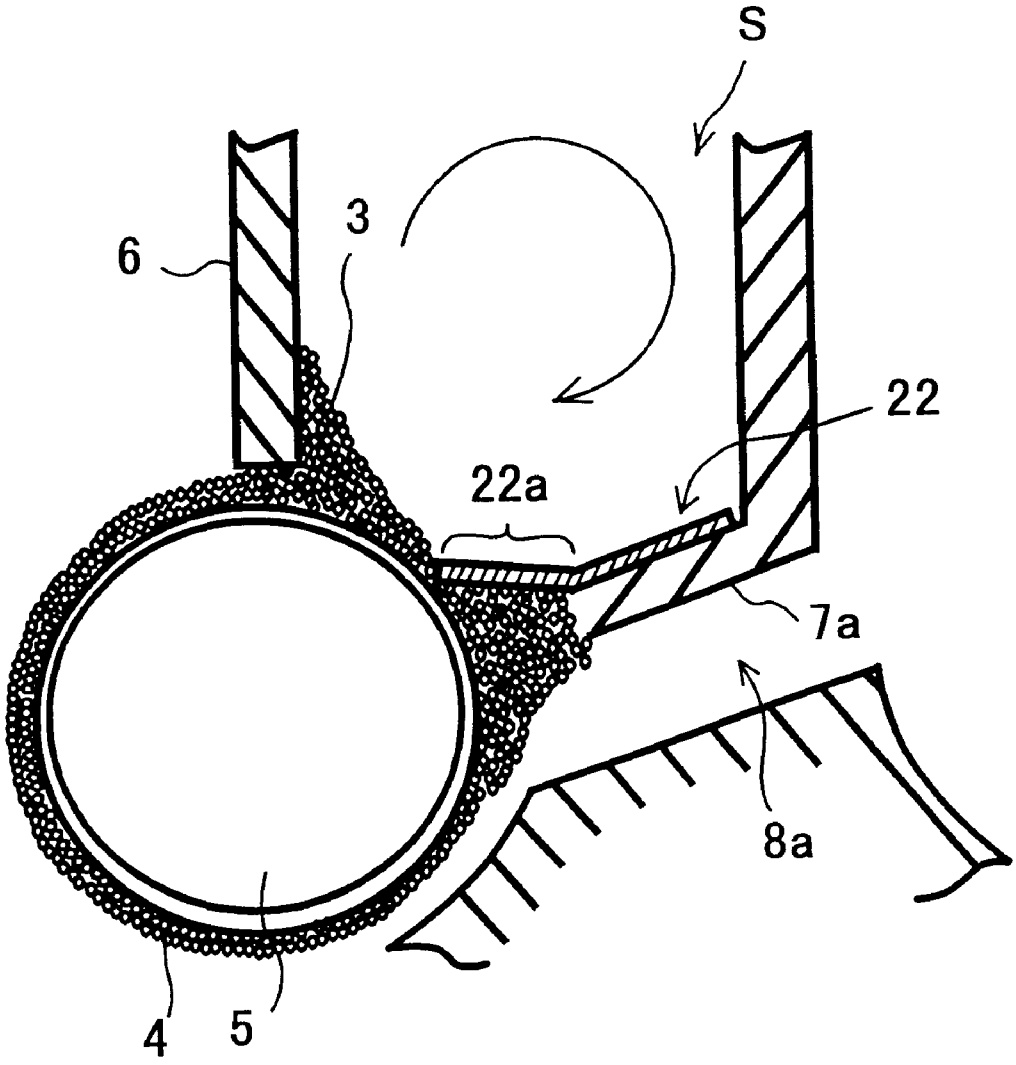
FIG. 28 is an enlarged schematic drawing illustrating the developer accommodating part and the toner take-in part of the developing device, in which another example of the sheet member is included.

FIG. 28 is an enlarged schematic drawing illustrating the developer accommodating part S and a toner take-in part of the developing device, that includes another example of the sheet member. According to this example of the sheet member, a free end part 22*a* of a sheet member 22 is longer than a shortest length to reach a surface of the developing sleeve 4. Because of this length of the free end part 22*a*, a tip end of the free end part 22*a* contacts a surface of the developing sleeve 4, and with a movement of the developing sleeve 4, the free end part 22*a* is bent toward the downstream side in the developer moving direction by being pulled by the developer carried and conveyed by the developing sleeve 4. The position of the tip end of the free end part 22*a* when the free end part 22*a* is thus bent defines the third regulating position. The toner 3*a* carried and conveyed by the developing sleeve 4 is moved relative to the sheet contacting member 22 while contacting the sheet member 22. The excessive toner 3*a* is thus regulated at the third regulating position and at the same time the toner density in the developer is made uniform in the image width direction perpendicular to the developer conveying direction by the developing sleeve 4.

Thus, the excessive toner 3*a* is removed and the toner 3*a* which has been uniformly distributed in the image width direction is taken into the developer on the developing sleeve 4, and the developer containing the uniformly distributed toner 3*a* passes the regulating position by the doctor 6 to be used for development.

Good images were obtained without having uneven image density in the image width direction in an experiment made using the developing device provided with the sheet member 22 as described above.

Figure 29:
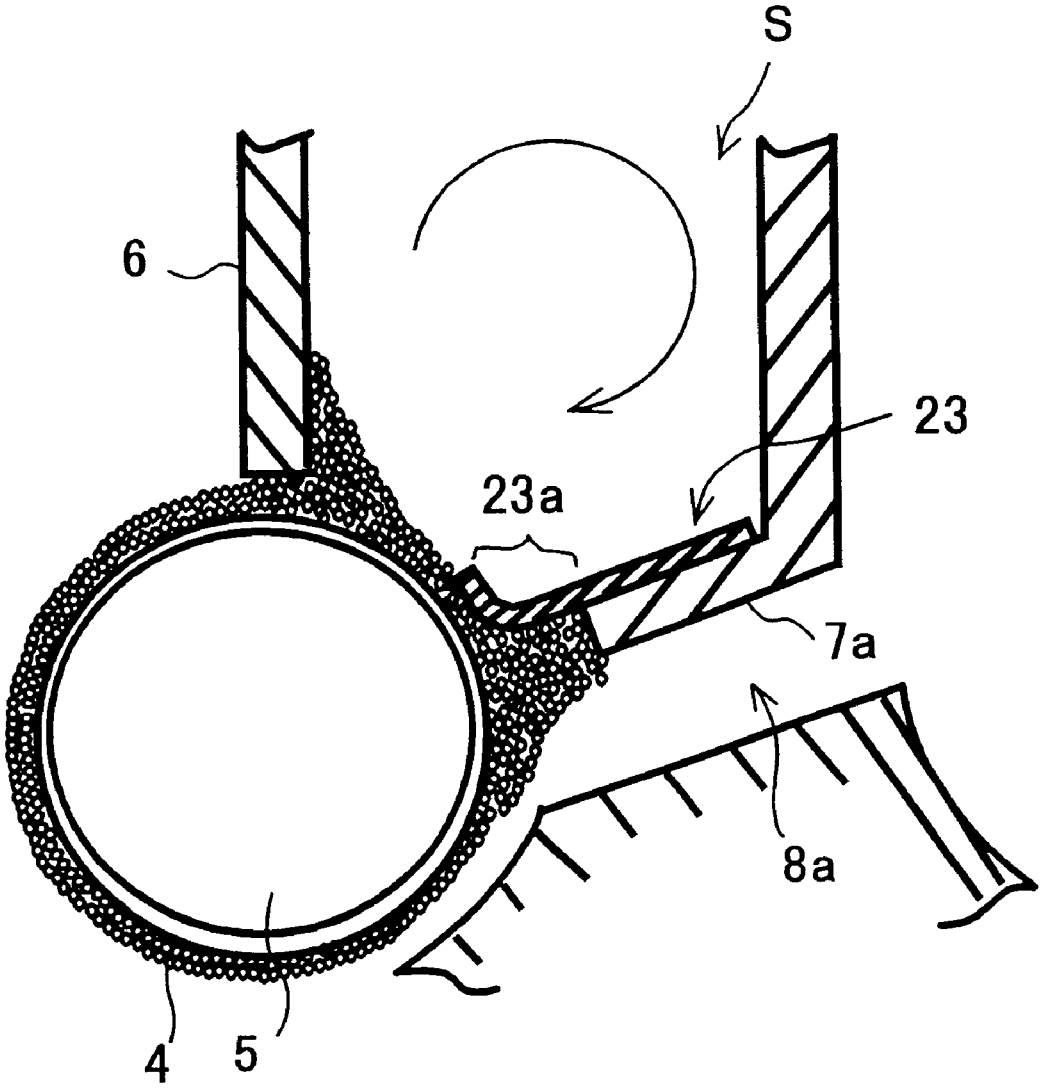
FIG. 29 is an enlarged schematic drawing illustrating the developer accommodating part and the toner take-in part of the developing device, in which another example of the sheet member is included.

FIG. 29 is an enlarged schematic drawing illustrating the developer accommodating part S and a toner take-in part of the developing device, in which another example of the sheet member is included. According to this example, a free end part 23*a* of a sheet member 23 is made longer than a shortest length to reach a surface of the developing sleeve 4 as in the immediately above example. In addition, the thickness of the sheet member 23 is made such that the free end part 23*a* is bent by a pressure caused by the conveyed developer on the developing sleeve 4, and thereby a surface of the free end part 23*a* contacts the conveyed developer on the developing sleeve 4 uniformly in the image width direction and for a relatively long distance in the developer conveying direction. The position of this surface contacting part of the free end part 23*a* of the sheet member 23 defines the third regulating position. With this configuration, the excessive toner 3*a* is removed and the toner 3*a* uniformly distributed in the image width direction is taken into the developer on the developing sleeve 4, and the developer containing thus uniformly distributed toner 3*a* passes the regulating position by the doctor 6 so as to be used for development.

Good images were obtained without having uneven image density in the image width direction in an experiment made using the developing device provided with the sheet member 23 as described above.

Figure 30:
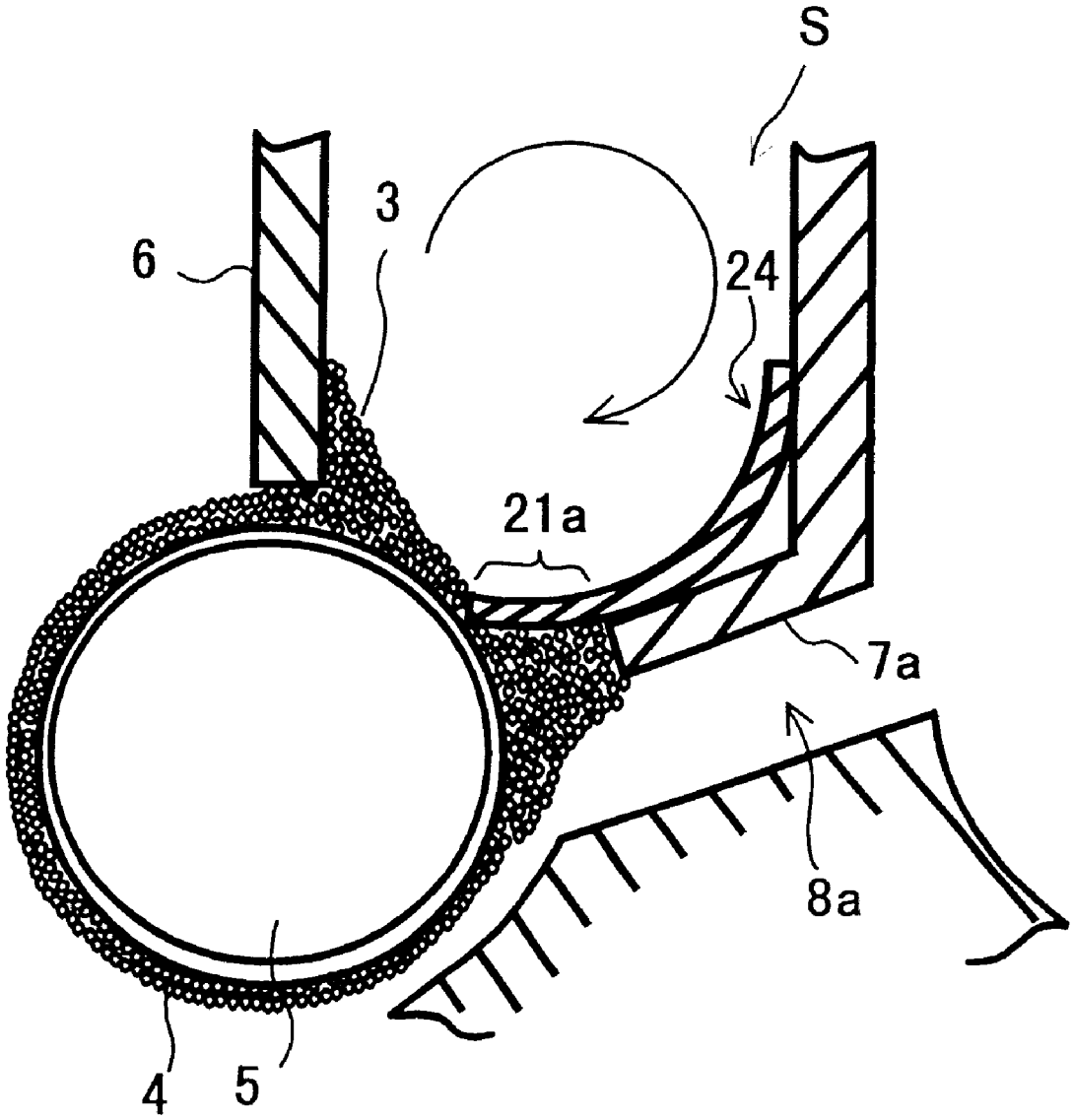
FIG. 30 is an enlarged schematic drawing illustrating the developer accommodating part and the toner take-in part of the developing device, in which another example of the sheet member is included.

FIG. 30 is an enlarged schematic drawing illustrating the developer accommodating part S and a toner take-in part of the developing device, in which another example of the sheet member is included. According to this example, a free end part 24*a* of a sheet member 24 is made longer than a shortest length to reach a surface of the developing sleeve 4 as in the immediately above example. In addition, the length of the free end part 24*a* of the sheet member 24 is made such that the free end part 24*a* is bent by a pressure caused by the conveyed developer on the developing sleeve 4 and such that the free end part 24*a* contacts the conveyed developer on the developing sleeve 4 uniformly in the image width direction and for a relatively long distance in the developer conveying direction. This surface contacting part of the free end part 24*a* of the sheet member 24 forms the third regulating position. With this configuration, the excessive toner 3*a* is removed and the toner 3*a* uniformly distributed in the image width direction is taken into the developer on the developing sleeve 4, and the developer containing thus uniformly distributed toner 3*a* passes the regulating position by the doctor 6 so as to be used for development.

Good images were obtained without having uneven image density in the image width direction in an experiment made using a developing device provided with the sheet member 24 as described above.

In the developing device of FIG. 30, the end part of the sheet member 24 opposite the free end part 24*a* is made longer than a length necessary for fixing this end part to the side of the pre-doctor 7*a* at the side of the developer accommodating part S. Specifically, this end part is made to extend over the internal surface of the pre-doctor 7*a* in a perpendicular direction relative to a surface of the developing sleeve 4 and that of a part of the side wall of the developer accommodating part S, which extends from the pre-doctor 7*a* upward by being bent. The sheet member 24 is pasted to the internal surface of the pre-doctor 7*a* to be bent such that the sheet member 24 is separated from the position of the internal surface of the pre-doctor 7*a* where the pre-doctor 7*a* is bent. With this configuration, the developer can be more smoothly circulated in the developer accommodating part S. Thus, even if the shape of the internal surface of the developer accommodating part S is made to include such a bending portion and is not smooth enough to circulate the developer, such a bending portion can be covered by the sheet member 24 so that the developer can be smoothly circulated in the developer accommodating space S.

Figure 31:
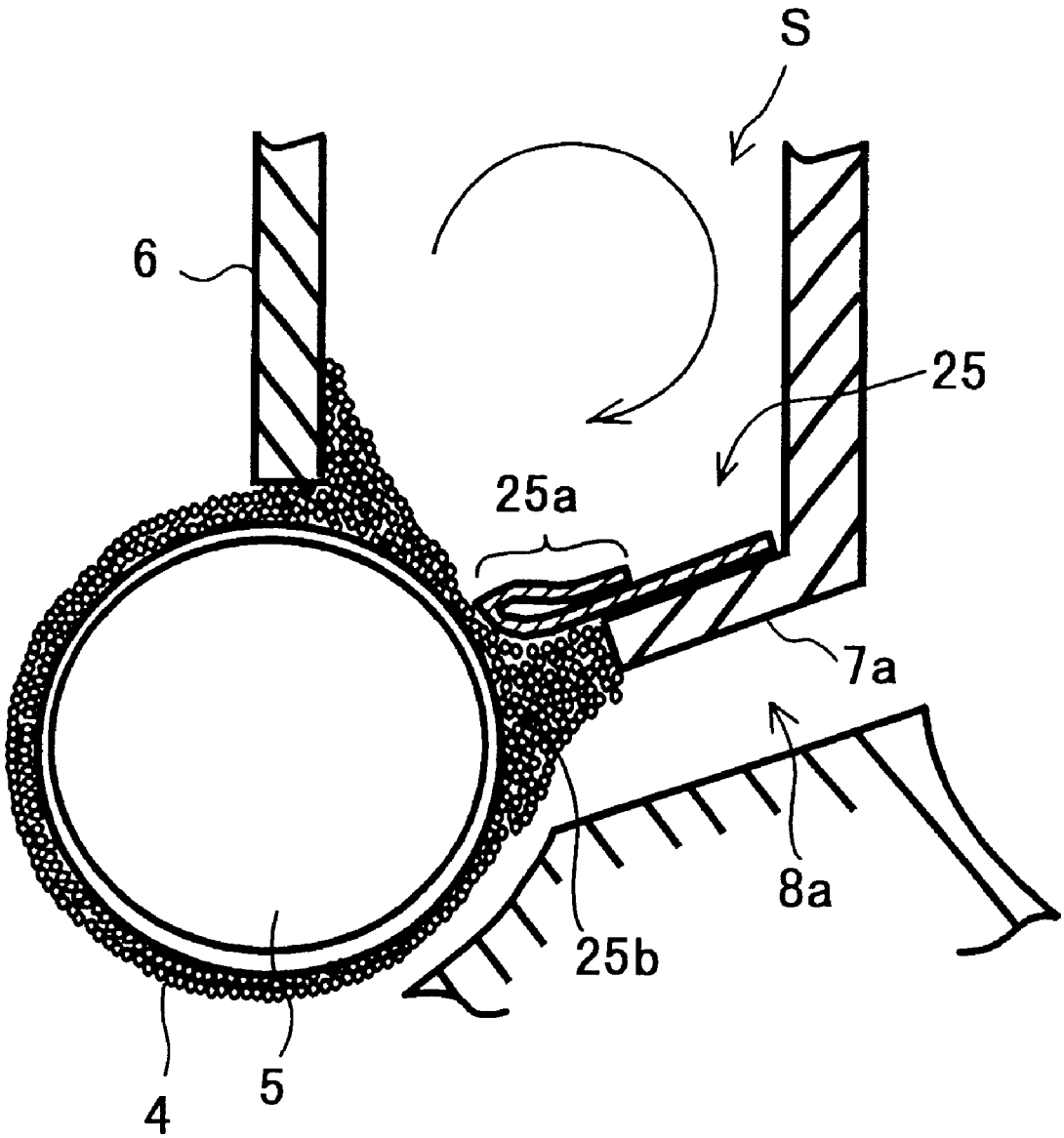
FIG. 31 is an enlarged schematic drawing illustrating the developer accommodating part and the toner take-in part of the developing device, in which another example of the sheet member is included.

FIG. 31 is an enlarged schematic drawing illustrating the developer accommodating part S and a toner take-in part of the developing device, in which another example of the sheet member is included. According to this example, a free end part 25*a* of a sheet member 25 is made sufficiently longer than a shortest length to reach a surface of the developing sleeve 4, such that the free end part 25*a* is rolled up and an outer circumferential part 25*b* at a curved part of the rolled up free end part 25*a* contacts the conveyed developer on the developing sleeve 4. With this rolling up configuration, the sheet member 25 is strengthened, and the position of the contacting part of the free end part 25*a* of the sheet member 25 defines the third regulating position. With this configuration, the excessive toner 3*a* is removed and the toner 3*a* uniformly distributed in the image width direction is taken into the developer on the developing sleeve 4, and the developer containing thus uniformly distributed toner 3*a* passes the regulating position by the doctor 6 so as to be used for development.

Good images were obtained without having uneven image density in the image width direction in an experiment made using the developing device provided with the sheet member 25 as described above.

As described above, in the developing device according to the above embodiment, the sheet members 21–25 regulate the take-in of the toner 3*a* into the developer and make the toner density in the developer uniform in the image width direction such that uneven image density is prevented.

Further, with respect to the stirring comb member 20 and the sheet members 21–25, the toner density is made uniform in the longitudinal direction of the developing sleeve 4 only by fixing these members in the developer accommodating part S. Therefore, it is not necessary to provide and drive by a motor a member for stirring the developer in the developer accommodating part S. Accordingly, an effect of avoiding uneven image density in the image width direction can be obtained at relatively low cost.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Applications No. 11-174693, No. 11-187727, No. 11-188219, No. 11-269348, No. 11-272551, and No. xx-xxxxxx, respectively filed in the Japanese Patent Office on Jun. 21, 1999, Jul. 1, 1999, Jul. 1, 1999, Sep. 22, 1999, Sep. 27, 1999, and May xx, 2000, and the entire contents of which are hereby incorporated herein by reference.

What is claimed as new and is desired to be secured by Letter Patent of the United State is:

1. A developing device, comprising:

a developer bearing member including an internal magnetic field generating device and configured to carry and convey a developer, including toner and carrier, on its surface;

a developer regulating member configured to regulate a quantity of the developer carried and conveyed by the developer bearing member toward a developing area;

a developer accommodating unit configured to accommodate the developer regulated to be conveyed toward the developing area by the developer regulating member; and a toner accommodating unit including a toner supplying opening opposing a surface of the developer bearing member at a position adjacent to and upstream of the developer accommodating unit in a developer conveying direction, wherein the toner in the toner accommodating unit is taken into the developer on the developer bearing member based on a toner density of the developer on the developer bearing member by a movement of the developer with a conveyance of the developer on the developer bearing member; and a peeling off member opposing, without contacting, a surface of the developer bearing member in the developer accommodating unit and configured to peel off an upper layer part of the developer carried and conveyed by the developer bearing member.

2. A developing device according to claim 1, further comprising:

a second developer regulating member located between the toner supplying opening of the toner accommodating unit and the developer accommodating unit and configured to regulate a quantity of the developer carried and conveyed by the developer bearing member toward the developer accommodating unit from the toner supplying opening of the toner accommodating unit, and wherein a gap between the second regulating member and a surface of the developer nearing member is set such that an amount of the developer regulated by the second developer regulating member increases as the toner density of the developer on the developer bearing member increases.

3. A developing device according to claim 2, wherein a relation $0<Gh<Gd2$ is satisfied, wherein Gh is a gap between the peeling off member and the surface of the developer bearing member and Gd2 is the gap between the second developer regulating member and the surface of the developer member.

4. A developing device according to claim 2, wherein the magnetic force generating device is configured so as not to have a magnetic pole between a position opposing the peeling off member and a position opposing the second developer regulating member.

5. A developing device according to claim 4, wherein a magnetic flux density on a surface of the developer bearing member from the position opposing the second developer regulating member and the position opposing the peeling off member is such that the developer is carried on the surface of the developer bearing member by a magnetic force.

6. A developing device according to claim 1, wherein:

the peeling off member comprises a roller-like shaped rotating member; and the developing device further comprises a rotation driving device configured to drive the peeling off member to rotate such that a surface of the peeling off member moves, at a position opposing the developer bearing member, in a direction opposite a direction in which the surface of the developer bearing member moves.

7. A developing device according to claim 6, wherein the peeling off member includes a magnetic member.

8. A developing device according to claim 7, wherein:

the peeling off member is supported at its both ends in a direction perpendicular to a direction of conveying the developer on the developer bearing member; and a diameter of the peeling off member at its center in the direction perpendicular to the developer conveying direction is smaller than diameters at both ends of the peeling off member.

9. A developing device according to claim 1, wherein:

the peeling off member extends in a direction perpendicular to a direction of conveying the developer on the developer bearing member and includes a magnetic member; and the developing device further comprises a rotation driving device configured to drive the peeling off member to rotate such that a surface of the peeling off member moves, at a position opposing the developer bearing member, in a direction opposite a direction in which the surface of the developer bearing member moves.

10. A developing device according to claim 1, wherein:

the peeling off member extends in a direction perpendicular to a direction of conveying the developer on the developer bearing member and a magnetic pole is magnetized at a surface thereof; and the developing device further comprises a rotation driving device configured to drive the peeling off member to rotate such that a surface of the peeling off member moves, at a position opposing the developer bearing member, in a direction opposite a direction in which the surface of the developer bearing member moves.

11. A developing device according to claim 10, wherein:

the peeling off member comprises a roller-like shaped rotating member; and a plurality of magnetic poles are magnetized at a surface of the peeling off member.

12. A developing device according to claim 11, wherein the plurality of magnetic poles are magnetized such that S and N poles are alternately arranged.

13. A developing device according to claim 12, wherein each of the plurality of magnetic poles is magnetized liearly in an extending direction of a rotation axis of the peeling off member.

14. A developing device according to claim 11, wherein the plurality of magnetic poles are magnetized such that a plurality of N and S poles alternately arranged in the extending direction of the peeling off member are arranged in a circumferential direction of the peeling off roller.

15. A developing device according to claim 6, wherein the rotation driving device drives the peeling off member to rotate at varied speeds.

16. A developing device according to claim 15, further comprising:

a control device configured to control the rotation driving device according to an image portion ratio of an image for printing.

17. A developing device according to claim 15, further comprising:

a temperature measuring device configured to measure a temperature inside of the developing device; and a control device configured to control the rotation driving device according to a result of measuring the temperature with the temperature measuring device.

18. A developing device according to claim 15, further comprising:

a humidity measuring device configured to measure a humidity inside of the developing device; and a control device configured to control the rotation driving device according to a result of measuring the humidity with the humidity measuring device.

19. A developing device according to claim 15, wherein the rotation driving device is controlled such that a relation $0.5<T/S<1.5$ is satisfied, wherein S(mm/s) is a linear speed of the developer bearing member and T(mm/s) is a linear speed of the peeling off member.

20. A developing device according to claim 6, wherein a surface of the peeling off member is coarse.

21. A developing device according to claim 7, wherein:

the peeling off member comprises a magnetic member; and the peeling off member opposes a peak position of a magnetic flux density distribution in a direction of a normal line on a surface of the developer bearing member.

22. A developing device according to claim 21, wherein a magnetic flux density distribution in a direction of a normal line at a circumferential surface of the peeling off roller opposite a side thereof opposing the developer bearing member is greater than 5 mT.

23. A developing device according to claim 21, further comprising:

a second developer regulating member located between the toner supplying opening of the toner accommodating unit and the developer accommodating unit to regulate a quantity of the developer carried and conveyed by the developer bearing member toward the developer accommodating unit from the toner supplying opening of the toner accommodating unit; and wherein a relation $MF2<(2/3)MF1$ is satisfied, wherein MF1 is a magnetic force received by the developer on the developing bearing member at a position opposing the peeling off roller and MF2 is a magnetic force received by the developer on the developing bearing member at a position opposing the second developer regulating member.

24. A developing device according to claim 1, wherein:

the peeling off member includes a scooping surface extending in a direction perpendicular to a direction of conveying the developer on the developer bearing member configured to scoop an upper layer of the developer on the developer bearing member to be peeled off the developer bearing member; and a scooping angle of the scooping surface of the peeling off member relative to a tangent line in a direction of conveying the developer at a surface of the developer bearing member is greater than 90 degrees.

25. A developing device according to claim 1, wherein the peeling off member is a grid-like flat plate.

26. A developing device, comprising:

a developer bearing member including an internal magnetic field generating device configured to carry and convey a developer, including toner and carrier, on its surface;

a developer regulating member configured to regulate a quantity of the developer carried and conveyed by the developer bearing member toward a developing area;

a developer accommodating unit configured to accommodate the developer regulated to be conveyed toward the developing area by the developer regulating member; and a toner accommodating unit including a toner supplying opening opposing a surface of the developer bearing member at a position adjacent to and upstream of the developer accommodating unit in a developer conveying direction, wherein the toner in the toner accommodating unit is taken into the developer on the developer bearing member based on a toner density of the developer on the developer bearing member by a movement of the developer with a conveyance of the developer on the developer bearing member; and a developer stirring member opposing, without contacting, a surface of the developer bearing member in the developer accommodating unit at a position adjacent to the toner accommodating unit so as to stir a part of the developer carried and conveyed by the developer bearing member, where the toner is taken into the developer from the toner accommodating unit, wherein the developer stirring member comprises a comb-like member having comb teeth at one end thereof.

27. A developing device according to claim 26, further comprising a second developer regulating member located between the toner supplying opening of the toner accommodating unit and the developer accommodating unit and configured to regulate a quantity of the developer carried and conveyed by the developer bearing member toward the developer accommodating unit from the toner supplying opening of the toner accommodating unit.

28. A developing device according to claim 26, wherein a relation $0<Gk<Gd$ is satisfied, wherein Gd is a gap between a surface of the developer bearing member and the second developer regulating member and Gk is a gap between a surface of the developer bearing member and a tip end of the comb teeth of the comb-like member.

29. A developing device according to claim 26, wherein an interval between tip ends of the comb teeth of the comb-like member is less than 5 mm.

30. A developing device, comprising:

a developer bearing member including an internal magnetic field generating device configured to carry and convey a developer, including toner and carrier, on its surface;

a developer regulating member configured to regulate a quantity of the developer carried and conveyed by the developer bearing member toward a developing area;

a developer accommodating unit configured to accommodate the developer regulated to be conveyed toward the developing area by the developer regulating member; and a toner accommodating unit including a toner supplying opening opposing a surface of the developer bearing member at a position adjacent to and upstream of the developer accommodating unit in a developer conveying direction, wherein the toner in the toner accommodating unit is taken into the developer on the developer bearing member based on a toner density of the developer on the developer bearing member by a movement of the developer with a conveyance of the developer on the developer bearing member; and a flexible plate-like member opposing, without contacting, a surface of the developer bearing member in the developer accommodating unit at a position adjacent to the toner accommodating unit so as to contact a part of the developer carried and conveyed by the developer bearing member, where the toner is taken into the developer from the toner accommodating unit.

31. A developing device according to claim 30, further comprising a second developer regulating member located between the toner supplying opening of the toner accommodating unit and the developer accommodating unit and configured to regulate a quantity of the developer carried and conveyed by the developer bearing member toward the developer accommodating unit from the toner supplying opening of the toner accommodating unit.

32. A developing device according to claim 30, wherein a length of a free end part of the flexible plate-like member from a fixed supporting part thereof is longer than a length of a virtual straight line extending from the fixed supporting part of the flexible plate-like member to a position on a surface of the developer bearing member.

33. A developing device according to claim 31, wherein a thickness of the flexible plate-like member is such that the flexible plate-like member is bent by a pressing force received from the developer carried and conveyed by the developer bearing member.

34. A developing device according to claim 32, wherein the length of the free end part of the flexible plate-like member from the fixed supporting part thereof is such that the free end part of the flexible plate-like member is bent by a pressing force received from the developer carried and conveyed by the developer bearing member.

35. A developing device according to claim 30, wherein a part of the flexible plate-like member opposing a surface of the developer bearing member is rolled up.

36. An image forming apparatus, comprising:

a latent image bearing member;

a latent image forming device configured to form a latent image on the latent image bearing member;

a developing device configured to develop the latent image on the latent image bearing member to form a toner image; and a transfer device configured to transfer the toner image onto a transfer sheet, the developing device comprising:

a developer bearing member including an internal magnetic field generating device and configured to carry and convey a developer, including toner and carrier, on its surface;

a developer regulating member configured to regulate a quantity of the developer carried and conveyed by the developer bearing member toward a developing area;

a developer accommodating unit configured to accommodate the developer regulated to be conveyed toward the developing area by the developer regulating member; and a toner accommodating unit including a toner supplying opening opposing a surface of the developer bearing member at a position adjacent to and upstream of the developer accommodating unit in a developer conveying direction, wherein the toner in the toner accommodating unit is taken into the developer on the developer bearing member based on a toner density of the developer on the developer bearing member by a movement of the developer with a conveyance of the developer on the developer bearing member; and a peeling off member opposing, without contacting, a surface of the developer bearing member in the developer accommodating unit and configured to peel off an upper layer part of the developer carried and conveyed by the developer bearing member.

37. An image forming apparatus according to claim 36, the developing device further comprising:

a second developer regulating member located between the toner supplying opening of the toner accommodating unit and the developer accommodating unit and configured to regulate a quantity of the developer carried and conveyed by the developer bearing member toward the developer accommodating unit from the toner supplying opening of the toner accommodating unit, and wherein a gap between the second regulating member and a surface of the developer nearing member is set such that an amount of the developer regulated by the second developer regulating member increases as the toner density of the developer on the developer bearing member increases.

38. An image forming apparatus according to claim 37, wherein a relation $0<Gh<Gd2$ is satisfied, wherein Gh is a gap between the peeling off member and the surface of the developer bearing member and Gd2 is the gap between the second developer regulating member and the surface of the developer member.

39. An image forming apparatus according to claim 37, wherein the magnetic force generating device is configured so as not to have a magnetic pole between a position opposing the peeling off member and a position opposing the second developer regulating member.

40. An image forming apparatus according to claim 39, wherein a magnetic flux density on a surface of the developer bearing member from the position opposing the second developer regulating member and the position opposing the peeling off member is such that the developer is carried on the surface of the developer bearing member by a magnetic force.

41. An image forming apparatus according to claim 36, wherein:

the peeling off roller comprises a roller-like shaped rotating member; and the developing device further comprises a rotation driving device configured to drive the peeling off member to rotate such that a surface of the peeling off member moves, at a position opposing the developer bearing member, in a direction opposite a direction in which the surface of the developer bearing member moves.

42. An image forming apparatus according to claim 41, wherein the peeling off member includes a magnetic member.

43. An image forming apparatus according to claim 42, wherein:

the peeling off member is supported at its both ends in a direction perpendicular to a direction of conveying the developer on the developer bearing member; and a diameter of the peeling off member at its center in the direction perpendicular to the developer conveying direction is smaller than diameters at both ends of the peeling off member.

44. An image forming apparatus according to claim 36, wherein:

the peeling off member extends in a direction perpendicular to a direction of conveying the developer on the developer bearing member and includes a magnetic member; and the developing device further comprises a rotation driving device configured to drive the peeling off member to rotate such that a surface of the peeling off member moves, at a position opposing the developer bearing member, in a direction opposite a direction in which the surface of the developer bearing member moves.

45. An image forming apparatus according to claim 36, wherein:

the peeling off member extends in a direction perpendicular to a direction of conveying the developer on the developer bearing member and a magnetic pole is magnetized at a surface thereof; and the developing device further comprises a rotation driving device configured to drive the peeling off member to rotate such that a surface of the peeling off member moves, at a position opposing the developer bearing member, in a direction opposite a direction in which the surface of the developer bearing member moves.

46. An image forming apparatus according to claim 45, wherein:

the peeling off member comprises a roller-like shaped rotating member; and a plurality of magnetic poles are magnetized at a surface of the peeling off member.

47. An image forming apparatus according to claim 46, wherein the plurality of magnetic poles are magnetized such that S and N poles are alternately arranged.

48. An image forming apparatus according to claim 47, wherein each of the plurality of poles is magnetized linearly in an extending direction of a rotation axis of the peeling off member.

49. An image forming apparatus according to claim 46, wherein the plurality of magnetic poles are magnetized such that a plurality of N and S poles alternately arranged in the extending direction of the peeling off member are arranged in a circumferential direction of the peeling off roller.

50. An image forming apparatus according to claim 41, wherein the rotation driving device drives the peeling off member to rotate at varied speeds.

51. An image forming apparatus according to claim 50, further comprising:

a control device configured to control the rotation driving device according to an image ratio of an image for printing.

52. An image forming apparatus according to claim 50, further comprising:

a temperature measuring device configured to measure a temperature inside of the developing device; and a control device configured to control the rotation driving device according to a result of measuring the temperature with the temperature measuring device.

53. An image forming apparatus according to claim 50, further comprising:

a humidity measuring device configured to measure a humidity inside of the developing device; and a control device configured to control the rotation driving device according to a result of measuring the humidity with the humidity measuring device.

54. A developing device according to claim 50, wherein the rotation driving device is controlled such that a relation $0.5<T/S<1.5$ is satisfied, wherein S(mm/s) is a linear speed of the developer bearing member and T(mm/s) is a linear speed of the peeling off member.

55. An image forming apparatus according to claim 41, wherein a surface of the peeling off member is coarse.

56. An image forming apparatus according to claim 42, wherein:

the peeling off member comprises a magnetic member; and the peeling off member opposes a peak position of a magnetic flux density distribution in a direction of a normal line on a surface of the developer bearing member.

57. An image forming apparatus according to claim 56, wherein a magnetic flux density distribution in a direction of a normal line at a circumferential surface of the peeling off roller opposite a side thereof opposing the developer bearing member is greater than 5 mT.

58. An image forming apparatus according to claim 56, further comprising:

a second developer regulating member located between the toner supplying opening of the toner accommodating unit and the developer accommodating unit to regulate a quantity of the developer carried and conveyed by the developer bearing member toward the developer accommodating unit from the toner supplying opening of the toner accommodating unit; and wherein a relation $MF2<(2/3)MF1$ is satisfied, wherein MF1 is a magnetic force received by the developer on the developing bearing member at a position opposing the peeling off roller and MF2 is a magnetic force received by the developer on the developing bearing member at a position opposing the second developer regulating member.

59. An image forming apparatus according to claim 36, wherein:

the peeling off member includes a scooping surface extending in a direction perpendicular to a direction of conveying the developer on the developer bearing member configured to scoop an upper layer of the developer on the developer bearing member to be peeled off the developer bearing member; and a scooping angle of the scooping surface of the peeling off member relative to a tangent line in a direction of conveying the developer at a surface of the developer bearing member is than 90 degrees.

60. An image forming apparatus according to claim 36, wherein the peeling off member is a grid-like flat plate.

61. An image forming apparatus, comprising:

a latent image bearing member;

a latent image forming device configured to form a latent image on the latent image bearing member;

a developing device configured to develop the latent image on the latent image bearing member to form a toner image; and a transfer device configured to transfer the toner image onto a transfer sheet, the developing device comprising:

a developer bearing member including an internal magnetic field generating device and configured to carry and convey a developer, including toner and carrier, on its surface;

a developer regulating member configured to regulate a quantity of the developer carried and conveyed by the developer bearing member toward a developing area;

a developer accommodating unit configured to accommodate the developer regulated to be conveyed toward the developing area by the developer regulating member;

a toner accommodating unit including a toner supplying opening opposing a surface of the developer bearing member at a position adjacent to and upstream of the developer accommodating unit in a developer conveying direction, wherein the toner in the toner accommodating unit is taken into the developer on the developer bearing member based on a toner density of the developer on the developer member by a movement of the developer with a conveyance of the developer on the developer bearing member;

a developer stirring member opposing, without contacting, a surface of the developer bearing member in the developer accommodating unit at a position adjacent to the toner accommodating unit so as to stir a part of the developer carried and conveyed by the developer bearing member, where the toner is taken into the developer from the toner accommodating unit, wherein the developer stirring member comprises a comb-like member having comb teeth at one end thereof.

62. An image forming apparatus according to claim 61, the developing device further comprising a second developer regulating member located between the toner supplying opening of the toner accommodating unit and the developer accommodating unit and configured to regulate a quantity of the developer carried and conveyed by the developer bearing member toward the developer accommodating unit from the toner supplying opening of the toner accommodating unit.

63. An image forming apparatus according to claim 61, wherein a relation $0<Gk<Gd$ is satisfied, wherein Gd is a gap between a surface of the developer bearing member and the second developer regulating member and Gk is a gap between a surface of the developer bearing member and a tip end of the comb teeth of the comb-like member.

64. An image forming apparatus according to claim 61, wherein an interval between tip ends of the comb teeth of the comb-like member is less than 5 mm.

65. An image forming apparatus, comprising:

a latent image bearing member;

a latent image forming device configured to form a latent image on the latent image bearing member;

a developing device configured to develop the latent image on the latent image bearing member to form a toner image; and a transfer device configured to transfer the toner image onto a transfer sheet, the developing device comprising:

a developer bearing member including an internal magnetic field generating device and configured to carry and convey a developer, including toner and carrier, on its surface;

a developer regulating member configured to regulate a quantity of the developer carried and conveyed by the developer bearing member toward a developing area;

a developer accommodating unit configured to accommodate the developer regulated to be conveyed toward the developing area by the developer regulating member; and a toner accommodating unit including a toner supplying opening opposing a surface of the developer bearing member at a position adjacent to and upstream of the developer accommodating unit in a developer conveying direction, wherein the toner in the toner accommodating unit is taken into the developer on the developer bearing member based on a toner density of the developer on the developer bearing member by a movement of the developer with a conveyance of the developer on the developer bearing member; and a flexible plate-like member opposing, without contacting, a surface of the developer bearing member in the developer accommodating unit at a position adjacent to the toner accommodating unit so as to contact a part of the developer carried and conveyed by the developer bearing member, where the toner is taken into the developer from the toner accommodating unit.

66. An image forming apparatus according to claim 65, the developing device further comprising a second developer regulating member located between the toner supplying opening of the toner accommodating unit and the developer accommodating unit and configured to regulate a quantity of the developer carried and conveyed by the developer bearing member toward the developer accommodating unit from the toner supplying opening of the toner accommodating unit.

67. An image forming apparatus according to claim 65, wherein a length of a free end part of the flexible plate-like member from a fixed supporting part thereof is longer than a length of a virtual straight line extending from the fixed supporting part of the flexible plate-like member to a position on a surface of the developer bearing member the free end part of the flexible plate-like member contacts.

68. An image forming apparatus according to claim 65, wherein a thickness of the flexible plate-like member is such that the flexible plate-like member is bent by a pressing force received from the developer carried and conveyed by the developer bearing member.

69. An image forming apparatus according to claim 67, wherein the length of the free end part of the flexible plate-like member from the fixed supporting part thereof is such that the free end part of the flexible plate-like member is bent by a pressing force received from the developer carried and conveyed by the developer bearing member.

70. An image forming apparatus according to claim 65, wherein a part of the flexible plate-like member opposing a surface of the developer bearing member is rolled up.

71. A developing device, comprising:

developer bearing means, including internal means for generating a magnetic field, for carrying and conveying a developer, including toner and carrier, on a surface;

means for regulating a quantity of the developer carried and conveyed by the developer bearing means toward a developing area;

means for accommodating the developer regulated to be conveyed toward the developing area by the developer regulating means; and means for accommodating toner, including a toner supplying opening opposing a surface of the developer bearing means at a position adjacent to and upstream of the developer accommodating means in a developer conveying direction, wherein the toner in the toner accommodating means is taken into the developer on the developer bearing means based on a toner density of the developer on the developer bearing means by a movement of the developer with a conveyance of the developer on the developer bearing means; and means for peeling off the developer from the developer bearing means, without contacting a surface of the developer bearing means in the developer accommodating means to peel off an upper layer part of the developer carried and conveyed by the developer bearing means.

72. A developing device, comprising:

developer bearing means including internal means for generating a magnetic field for carrying and conveying a developer, including toner and carrier, on a surface;

means for regulating a quantity of the developer carried and conveyed by the developer bearing means toward a developing area;

means for accommodating the developer regulated to be conveyed toward the developing area by the developer regulating means; and means for accommodating toner, including a toner supplying opening opposing a surface of the developer bearing means at a position adjacent to and upstream of the developer accommodating means in a developer conveying direction, wherein the toner in the toner accommodating means is taken into the developer on the developer bearing means based on a toner density of the developer on the developer bearing means by a movement of the developer with a conveyance of the developer on the developer bearing means; and means for stirring the developer, without contacting a surface of the developer bearing means, in the developer accommodating means at a position adjacent to the toner accommodating means so as to stir a part of the developer carried and conveyed by the developer bearing means, where the toner is taken into the developer from the toner accommodating means, and including a comb-like member having comb teeth at one end thereof.

73. A developing device, comprising:

developer bearing means including internal means for generating a magnetic field, for carrying and conveying a developer including, toner and carrier, on a surface;

means for regulating a quantity of the developer carried and conveyed by the developer bearing means toward a developing area;

means for accommodating the developer regulated to be conveyed toward the developing area by the developer regulating means; and means for accommodating toner, including a toner supplying opening opposing a surface of the developer bearing means at a position adjacent to and upstream of the developer accommodating means in a developer conveying direction, wherein the toner in the toner accommodating means is taken into the developer on the developer bearing means based on a toner density of the developer on the developer bearing means by a movement of the developer with a conveyance of the developer on the developer bearing means; and a flexible plate-like means opposing, without contacting, a surface of the developer bearing member in the developer accommodating unit at a position adjacent to the toner accommodating unit for contacting a part of the developer carried and conveyed by the developer bearing member, where the toner is taken into the developer from the toner accommodating unit.

74. An image forming apparatus, comprising:

means for bearing a latent image;

means for forming the latent image on the latent image bearing means;

means for developing the latent image on the latent image bearing means to form a toner image; and means for transferring the toner image onto a transfer sheet, the developing means comprising:

developer bearing means including internal means for generating a magnetic field, for carrying and conveying a developer, including toner and carrier, on a surface;

means for regulating a quantity of the developer carried and conveyed by the developer bearing means toward a developing area;

means for accommodating the developer regulated to be conveyed toward the developing area by the developer regulating means; and means for accommodating toner, including a toner supplying opening opposing a surface of the developer bearing means at a position adjacent to and upstream of the developer accommodating means in a developer conveying direction, wherein the toner in the toner accommodating means is taken into the developer on the developer bearing means based on a toner density of the developer on the developer bearing means by a movement of the developer with a conveyance of the developer on the developer bearing means; and means for peeling off the developer from the developer bearing means, without contacting a surface of the developer bearing means in the developer accommodating means to peel off an upper layer part of the developer carried and conveyed by the developer bearing means.

75. An image forming apparatus, comprising:

means for bearing a latent image;

means for forming the latent image on the latent image bearing means;

means for developing the latent image on the latent image bearing means to form a toner image; and means for transferring the toner image onto a transfer sheet, the developing means comprising:

developer bearing means including internal means for generating a magnetic field, for carrying and conveying a developer including, toner and carrier, on a surface;

means for regulating a quantity of the developer carried and conveyed by the developer bearing means toward a developing area;

means for accommodating the developer regulated to be conveyed toward the developing area by the developer regulating means; and means for accommodating toner, including a toner supplying opening opposing a surface of the developer bearing means at a position adjacent to and upstream of the developer accommodating means in a developer conveying direction, wherein the toner in the toner accommodating means is taken into the developer on the developer bearing means based on a toner density of the developer on the developer bearing means by a movement of the developer with a conveyance of the developer on the developer bearing means; and means for stirring the developer, without contacting a surface of the developer bearing means in the developer accommodating means at a position adjacent to the toner accommodating means so as to stir a part of the developer carried and conveyed by the developer bearing means, where the toner is taken into the developer from the toner accommodating means, and including a comb-like member having comb teeth at one end thereof.

76. An image forming apparatus, comprising:

means for bearing a latent image;

means for forming the latent image on the latent image bearing means;

means for developing the latent image on the latent image bearing means to form a toner image; and means for transferring the toner image onto a transfer sheet, the developing means comprising:

a developer bearing means including internal means for generating a magnetic field, for carrying and conveying a developer, including toner and carrier, on a surface;

means for regulating a quantity of the developer carried and conveyed by the developer bearing means toward a developing area;

means for accommodating the developer regulated to be conveyed toward the developing area by the developer regulating means; and means for accommodating toner, including a toner supplying opening opposing a surface of the developer bearing means at a position adjacent to and upstream of the developer accommodating means in a developer conveying direction, wherein the toner in the toner accommodating means is taken into the developer on the developer bearing means based on a toner density of the developer on the developer bearing means by a movement of the developer with a conveyance of the developer on the developer bearing means; and a flexible plate-like means opposing, without contacting, a surface of the developer bearing member in the developer accommodating unit at a position adjacent to the toner accommodating unit so as to contact a part of the developer carried and conveyed by the developer bearing member, where the toner is taken into the developer from the toner accommodating unit.

* * * * *